US009897349B2

(12) United States Patent
Tamaki et al.

(10) Patent No.: US 9,897,349 B2
(45) Date of Patent: Feb. 20, 2018

(54) REFRIGERATION CYCLE DEVICE

(71) Applicant: Mitsubishi Electric Corporation, Tokyo (JP)

(72) Inventors: Shogo Tamaki, Tokyo (JP); Ryo Oya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 150 days.

(21) Appl. No.: 14/889,016

(22) PCT Filed: May 24, 2013

(86) PCT No.: PCT/JP2013/064441
§ 371 (c)(1),
(2) Date: Nov. 4, 2015

(87) PCT Pub. No.: WO2014/188575
PCT Pub. Date: Nov. 27, 2014

(65) Prior Publication Data

US 2016/0116191 A1 Apr. 28, 2016

(51) Int. Cl.
*F25B 13/00* (2006.01)
*F25B 41/04* (2006.01)
(Continued)

(52) U.S. Cl.
CPC ..... *F25B 13/00* (2013.01); *F24H 9/2021* (2013.01); *F25B 41/04* (2013.01); *F25B 47/025* (2013.01);
(Continued)

(58) Field of Classification Search
CPC .... F25B 6/00; F25B 6/06; F25B 13/00; F25B 23/00; F25B 23/001; F25B 23/002;
(Continued)

(56) References Cited

U.S. PATENT DOCUMENTS 9,068,766 B2 * 6/2015 Tamaki ..... F24D 17/02
2011/0296861 A1 * 12/2011 Honda ..... F24D 3/08 62/238.7
(Continued)

FOREIGN PATENT DOCUMENTS

JP 02-150673 A 6/1990
JP 02-157568 A 6/1990
(Continued)

OTHER PUBLICATIONS

Japanese Office Action dated Oct. 4, 2016 in the corresponding JP application No. 2015-518012. (English translation attached).
(Continued)

*Primary Examiner* — Marc Norman
(74) *Attorney, Agent, or Firm* — Posz Law Group, PLC

(57) ABSTRACT

A refrigeration cycle apparatus includes: a refrigeration cycle circuit including a compressor, a four-way valve, a heat source side heat exchanger, a heat source side pressure-reducing mechanism, an indoor side pressure-reducing mechanism, and an indoor side heat exchanger, and a hot water supply refrigerant circuit branching off from between the compressor and the four-way valve, including a hot water supply side heat exchanger and a hot water supply side pressure-reducing mechanism in order, and connected between the heat source side pressure-reducing mechanism and the indoor side pressure-reducing mechanism, wherein when a refrigerant state value on at least one of a low pressure side of the refrigeration cycle circuit and a discharge side of the compressor becomes a refrigerant collection start state value, a refrigerant collecting operation that collects refrigerant accumulated in the hot water supply refrigerant circuit into the refrigeration cycle circuit is started.

14 Claims, 7 Drawing Sheets

(51) Int. Cl.

| | |
|---|---|
| ***F25B 47/02*** | (2006.01) |
| ***F24H 9/20*** | (2006.01) |
| *F24H 4/04* | (2006.01) |

(52) U.S. Cl.

CPC ..... *F24H 4/04* (2013.01); *F25B 2313/021* (2013.01); *F25B 2313/0292* (2013.01); *F25B 2313/0293* (2013.01); *F25B 2313/0294* (2013.01); *F25B 2313/02741* (2013.01); *F25B 2313/0314* (2013.01); *F25B 2313/0315* (2013.01); *F25B 2339/047* (2013.01); *F25B 2341/0662* (2013.01); *F25B 2700/1931* (2013.01); *F25B 2700/21152* (2013.01); *F25B 2700/21163* (2013.01)

(58) Field of Classification Search

CPC ..... F25B 23/003; F25B 41/04; F25B 47/025; F25B 2313/021; F25B 2313/02471; F25B 2313/0292; F25B 2313/0293; F25B 2313/0314; F25B 2313/0315; F25B 2339/047; F25B 2341/0662; F25B 2700/1931; F25B 2700/21152; F25B 2700/21163; F24H 4/04; F24H 9/2021

See application file for complete search history.

(56) References Cited

U.S. PATENT DOCUMENTS

| | | | | |
|---|---|---|---|---|
| 2013/0019624 | A1* | 1/2013 | Tamaki | F24D 17/02 62/196.1 |
| 2014/0345310 | A1* | 11/2014 | Tamaki | F25B 13/00 62/238.6 |

FOREIGN PATENT DOCUMENTS

| | | | |
|---|---|---|---|
| JP | 05-196308 | A | 8/1993 |
| JP | 2001-227836 | A | 8/2001 |
| JP | 2004-205200 | A | 7/2004 |
| JP | 2004-278813 | A | 10/2004 |
| JP | 2009-222247 | A | 10/2009 |
| JP | 2010-196950 | A | 9/2010 |
| JP | 2011-231956 | A | 11/2011 |
| WO | 2013/051059 | A1 | 4/2013 |

OTHER PUBLICATIONS

International Search Report of the International Searching Authority dated Aug. 20, 2013 for the corresponding international application No. PCT/JP2013/064441 (and English translation).

* cited by examiner

REFRIGERATION CYCLE DEVICE

CROSS REFERENCE TO RELATED APPLICATION

This application is a U.S. national stage application of International Application No. PCT/JP2013/064441 filed on May 24, 2013, the disclosure of which is incorporated herein by reference.

TECHNICAL FIELD

The present invention relates to a refrigeration cycle apparatus capable of executing air conditioning operation and hot water supplying operation at the same time, and more particularly, to a refrigeration cycle apparatus that collects accumulated refrigerant in a hot water supply unit.

BACKGROUND ART

In the related art, on a refrigerant circuit formed by connecting an indoor unit and a hot water supply unit to a heat source unit by pipes, there exists a refrigeration cycle apparatus capable of indoor cooling operation and hot water supplying operation at the same time. In this system, a waste heat collecting operation that collects waste heat during indoor cooling as water-heating heat may be carried out, and highly efficient operation may be realized.

In the related art, in order to prevent refrigerant from flowing to an indoor unit (stopped unit) not conducting normal heating operation due to being stopped, set to ventilation mode, shut off by thermostat control, or the like, or a hot water supply unit (stopped unit) not conducting normal hot water supplying operation, a pressure-reducing mechanism is fully closed to prevent refrigerant from flowing. However, since the refrigerant flow rate is restricted, refrigerant accumulates in the heat exchangers installed in the units and the connecting pipes, causing operation with insufficient refrigerant in the refrigerant circuit of a refrigeration cycle apparatus. Although it is possible to prevent the accumulation of refrigerant in the heat exchangers and pipes by slightly opening the pressure-reducing mechanism and regulating the restriction of the refrigerant flow rate, the operating and environmental conditions are various, and reliably preventing the accumulation of refrigerant is difficult. It is also possible to prevent refrigerant accumulation by shutting off the inlet and outlet of the stopped unit with valves to set refrigerant inflow to zero, but refrigerant still flows in through structural gaps in the valves or the pressure-reducing mechanism, and reliably preventing the accumulation of refrigerant is difficult. For this reason, in the related art, technology that senses operation with insufficient refrigerant in the refrigeration cycle apparatus and collects refrigerant from the stopped unit has been developed (for example, see Patent Literature 1 and 2).

CITATION LIST

Patent Literature

Patent Literature 1: Japanese Unexamined Patent Application Publication No. 2009-222247

Patent Literature 2: Japanese Unexamined Patent Application Publication No. 2001-227836

SUMMARY OF INVENTION

Technical Problem

Patent Literature 1 describes an action that, upon judging that a temperature rise on a discharge line of a compressor has occurred for a predetermined time or more, senses an insufficiency of refrigerant, sets operating outdoor units and indoor units to cooling or defrosting mode with a mode switching unit, and in addition, by fully opening each expansion valve of the indoor units with an expansion valve control unit, returns dormant refrigerant from the indoor units, together with lubricant, to the operating outdoor units.

Also, Patent Literature 2 computes the temperature difference between a temperature detected by an outdoor heat exchanger refrigerant inlet temperature sensor and an outdoor heat exchanger refrigerant outlet temperature sensor, and determines whether or not the refrigerant flow rate in the outdoor unit is insufficient based on the temperature difference data. An action is described in which if the outdoor unit runs out of gas, refrigerant is judged to be dormant in the indoor heat exchanger of a stopped indoor unit, the valve opening degree of an indoor expansion valve is increased according to the amount of time the indoor unit has been stopped, or the valve opening degree of the indoor expansion valve is adjusted according to the heat exchange capacity of the indoor unit, and dormant refrigerant is collected back in the operating outdoor unit.

However, even if these methods of the related art are applied to a refrigeration cycle apparatus capable of collecting waste heat from cooling in a hot water supply unit, the determination of refrigerant accumulation in a stopped unit and refrigerant collection from the stopped unit cannot be conducted appropriately. Since the hot water supply unit is connected in parallel with a four-way valve for switching an indoor unit between heating and cooling, refrigerant present in the hot water supply unit is in a high-pressure environment even during cooling operation of the indoor unit, and refrigerant accumulates in the hot water supply unit. For this reason, a determination and action of refrigerant collecting operation compatible with cooling operation is required.

In addition, with a refrigeration cycle apparatus of the related art that switches between heating and cooling, since all use side heat exchangers are installed via a four-way valve, accumulated refrigerant in stopped indoor units may be collected by setting a defrosting operating mode, but with heating operation in a refrigeration cycle apparatus that collects waste heat in a hot water supply unit, the hot water supply unit is connected in parallel with the four-way valve, the hot water supply unit stays in a high-pressure environment even when the defrosting operating mode is set, and accumulated refrigerant cannot be collected.

For this reason, an action that collects refrigerant irrespectively of the carrying out of defrosting operation is required. Also, in a hot water supply operating mode of a refrigeration cycle apparatus that collects waste heat in a hot water supply unit, since the hot water supply unit is in a high-pressure environment during defrosting operation, refrigerant becomes insufficient for defrosting operation unless the refrigerant in the hot water supply unit is collected before the defrosting operation, thereby lengthening the time until defrosting finishes.

The present invention has been devised to solve problems like the above, and an objective thereof is to provide a refrigeration cycle apparatus capable of collecting waste heat in a hot water supply unit, which collects refrigerant accumulated in a heat exchanger and connecting pipes on the hot water supply unit by carrying out an appropriate start determination of refrigerant collecting operation and control of the refrigerant collection channel.

Solution to Problem

A refrigeration cycle apparatus of the present invention is a refrigeration cycle apparatus comprising: a refrigeration cycle circuit including a compressor, a four-way valve, a heat source side heat exchanger, a heat source side pressure-reducing mechanism, an indoor side pressure-reducing mechanism, and an indoor side heat exchanger, in which during cooling operation, the compressor, the four-way valve, the heat source side heat exchanger, the heat source side pressure-reducing mechanism, the indoor side pressure-reducing mechanism, and the indoor side heat exchanger are connected to allow refrigerant to circulate therethrough in named order; and a hot water supply refrigerant circuit branching off from between the compressor and the four-way valve, including a hot water supply side heat exchanger and a hot water supply side pressure-reducing mechanism connected in named order, and the hot water supply refrigerant circuit being connected between the heat source side pressure-reducing mechanism and the indoor side pressure-reducing mechanism, the refrigeration cycle apparatus being configured to start a refrigerant collecting operation that collects refrigerant accumulated in the hot water supply refrigerant circuit into the refrigeration cycle circuit when a refrigerant state value on at least one of a low pressure side of the refrigeration cycle circuit and a discharge side of the compressor becomes a refrigerant collection start state value.

Advantageous Effects of Invention

According to a refrigeration cycle apparatus of the present invention, refrigerant accumulated in a heat exchanger and connecting pipes on the hot water supply unit side may be collected appropriately, and thus the operation of the refrigeration cycle apparatus may be conducted stably.

DESCRIPTION OF EMBODIMENTS

Embodiment 1

Apparatus Configuration

Figure 1:
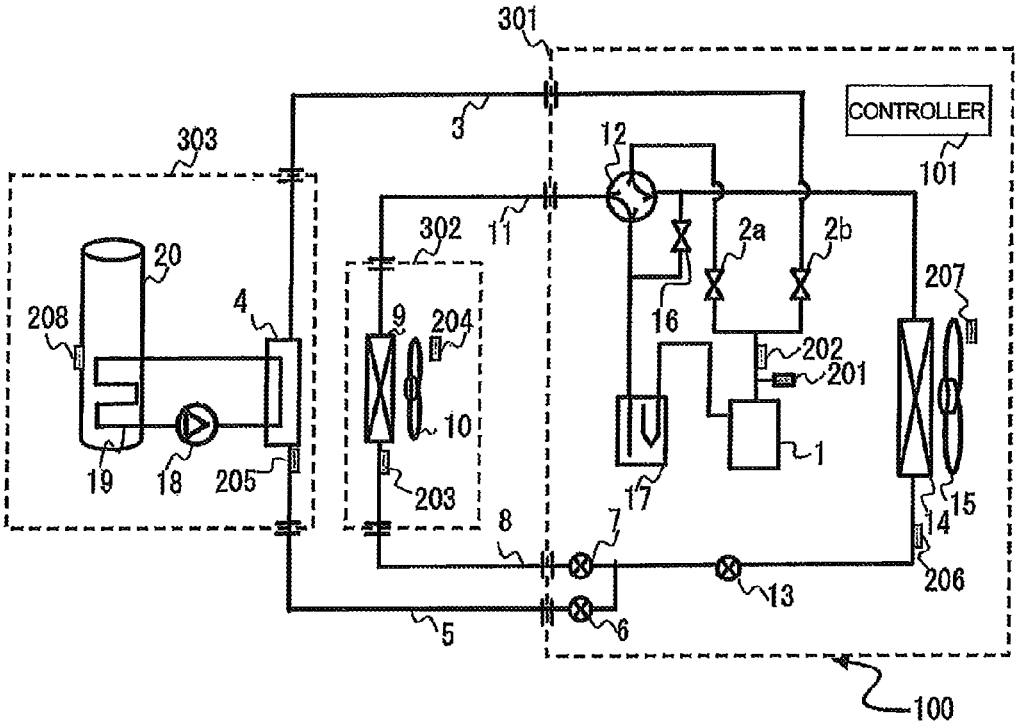
FIG. 1 is a schematic diagram illustrating a refrigerant circuit configuration in a refrigeration cycle apparatus 100.
Figure 2:
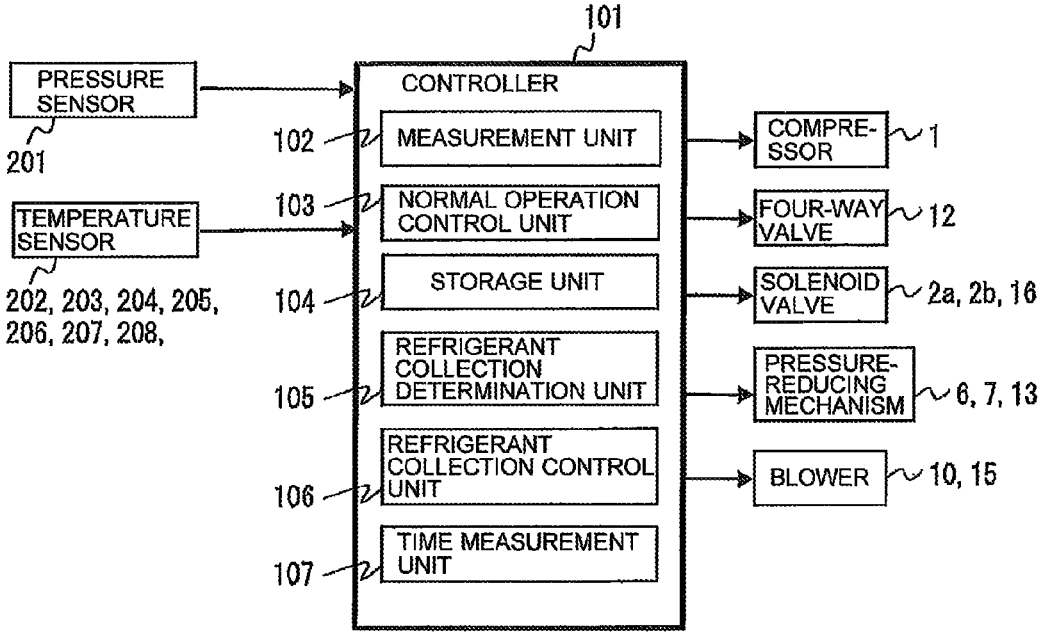
FIG. 2 is a block diagram illustrating a configuration of a controller 101 in a refrigeration cycle apparatus 100.

A configuration of a refrigeration cycle apparatus 100 of Embodiment 1 of the present invention will be described based on FIGS. 1 and 2. FIG. 1 is a refrigerant circuit configuration diagram of a refrigeration cycle apparatus 100 according to Embodiment 1. The refrigeration cycle apparatus 100, by conducting a vapor compression refrigeration cycle operation, is able to process simultaneously a cooling instruction (cooling on-off) and a heating instruction (heating on-off) from an indoor unit 302, and a hot water supply demand instruction (hot water supply on-off) in a hot water supply unit 303. A heat source unit 301 and an indoor unit 302 are connected by a refrigerant pipe that acts as an indoor side gas extension pipe 11 and a refrigerant pipe that acts as an indoor side liquid extension pipe 8. The heat source unit 301 and a hot water supply unit 303 are connected by a refrigerant pipe that acts as a water side gas extension pipe 3 and a refrigerant pipe that acts as a water side liquid extension pipe 5. Embodiment 1 illustrates an example of connecting one indoor unit and one hot water supply unit to one heat source unit, as illustrated in FIG. 1, but a case of connecting two or more indoor units and two or more hot water supply units may also be carried out. Also, the refrigerant used in the air conditioning device is not particularly limited. For example, HFC refrigerants such as R-410A and R-32, HCFC refrigerants, or natural refrigerants such as hydrocarbons and helium may be used.

The heat source unit 301 is made up of a compressor 1, discharge solenoid valves 2*a* and 2*b*, a solenoid valve 16, a four-way valve 12, an indoor side pressure-reducing mechanism 7, a hot water supply side pressure-reducing mechanism 6, a heat source side pressure-reducing mechanism 13, a heat source side heat exchanger 14, a heat source side blower 15, and an accumulator 17. The compressor 1 is a type whose rotation speed is controlled by an inverter to enable capacity control, and suctions and compresses refrigerant into a high temperature and high pressure state. The discharge side pipe connected to the compressor 1 branches partway through, with one branch connecting to the indoor side gas extension pipe 11 via the discharge solenoid valve 2*a* and the four-way valve 12, and the other branch connecting to the water side gas extension pipe 3 via the discharge solenoid valve 2*b*, respectively. The discharge solenoid valves 2*a* and 2*b*, the four-way valve 12, and the solenoid valve 16 control the flow direction of refrigerant. The heat source side heat exchanger 14 is a fin and tube heat exchanger with a cross-fin design made up of heat transfer pipes and fins, for example, and exchanges heat between outdoor air and refrigerant. The heat source side blower 15 is made up of a multi-blade fan or the like driven by a DC motor (not illustrated), and is able to regulate the air-sending rate, suctioning outdoor air into the heat source unit 301, and exhausting the air back outdoors after the air is made to exchange heat with refrigerant. In addition, the indoor side pressure-reducing mechanism 7 regulates the refrigerant flow rate of the indoor unit 302, while the hot water supply side pressure-reducing mechanism 6 regulates the refrigerant flow rate of the hot water supply unit 303. Also, the heat source side pressure-reducing mechanism 13 regulates the flow rate of refrigerant flowing into the heat source side heat exchanger 14. The accumulator 17 avoids excess refrigerant accumulation during operation and the suction of liquid refrigerant into the compressor 1 during a state change.

In addition, in the heat source unit 301, a pressure sensor 201 is provided on the discharge side of the compressor 1, and measures the refrigerant pressure at the installation location. Also, a temperature sensor 202 is provided on the discharge side of the compressor 1, while a temperature sensor 206 is provided on the liquid side of the heat source side heat exchanger 14, and these temperature sensors measure the refrigerant temperature at the installation locations. Also, a temperature sensor 207 is provided at the air inlet, and measures the outdoor air temperature.

The indoor unit 302 is made up of an indoor side heat exchanger 9 and an indoor side blower 10. The indoor side heat exchanger 9 is a fin and tube heat exchanger with a cross-fin design made up of heat transfer pipes and fins, for example, and exchanges heat between indoor air and refrigerant. The indoor side blower 10 is made up of a centrifugal fan or the like driven by a DC motor (not illustrated), and is able to regulate the air-sending rate, suctioning indoor air into the indoor unit 302, and blowing the air back indoors after the air is made to exchange heat with refrigerant by the indoor side heat exchanger 9.

In addition, in the indoor unit 302, a temperature sensor 203 is provided on the liquid side of the indoor side heat exchanger 9, and measures the refrigerant temperature at the installation location. Also, a temperature sensor 204 is provided at the indoor air inlet, and measures the temperature of indoor air flowing into the unit.

The hot water supply unit 303 is made up of a water side heat exchanger 4, a water pump 18, a coil heat exchanger 19, and a hot water tank 20, in which a water medium circulates as the medium of heat exchange. The water side heat exchanger 4 is made up of a plate heat exchanger, for example, exchanging heat between the water medium and the refrigerant to heat the water medium. The rotation speed of the water pump 18 is configured to be a fixed speed or variable with an inverter, and causes the water medium to circulate. The coil heat exchanger 19 is installed inside the hot water tank 20, causing heat exchange between the tank water in the hot water tank 20 and the water medium circulating through the water circuit, and heating the tank water to generate hot water. The hot water tank 20 is a water-filled type that stores boiled hot water, while in addition, hot water is dispensed from the top of the tank according to hot water demand, and low-temperature municipal water equal to the dispensed amount is supplied from the bottom of the tank (not illustrated). Note that the substance used for the water medium may be water, or brine mixed with antifreeze or the like. Note that the method of heating water in the hot water tank 20 by the hot water supply unit 303 is not limited to a heat exchange method using a water medium like in Embodiment 1, and may also be a heating method that causes water in the hot water tank 20 to flow directly into a pipe, exchange heat in the water side heat exchanger 4 as a water medium, and return back to the hot water tank 20.

The operating state of the water-side circuit will be described. Water medium sent by the water pump 18 in the hot water supply unit 303 is heated to high temperature by the refrigerant in the water side heat exchanger 4, and after that, flows into the hot water tank 20, heats the tank water via the coil heat exchanger 19, and becomes a lower temperature. After that, the water medium flows out of the hot water tank 20 and flows to the water pump 18 to be sent again and become warm water in the water side heat exchanger 4. By such a process, hot water is boiled in the hot water tank 20.

In the hot water supply unit 303, a temperature sensor 205 is provided on the liquid side of the water side heat exchanger 4, and measures the refrigerant temperature at the installation location. Also, a temperature sensor 208 is installed on the side of the hot water tank 20, and measures the water temperature at the height of the installation position inside the hot water tank 20.

Next, the controller 101 will be described. FIG. 2 is a block diagram illustrating a configuration of the controller 101 in the refrigeration cycle apparatus 100 according to Embodiment 1 of the present invention. FIG. 2 illustrates the controller 101 that controls the refrigeration cycle apparatus 100, as well as the connection configuration of a remote control (not illustrated), sensors, and actuators connected to the controller 101. Various quantities detected by the various temperature sensors and pressure sensors are input into a measurement unit 102, and each apparatus is controlled by a normal operation controller 103 on the basis of the input information. In addition, a storage unit 104 that stores information such as predetermined constants, configuration values transmitted from the remote control, and a refrigerant collection start temperature is built-in, and the stored content may be referenced and rewritten as appropriate. Also, the start of refrigerant collection operation is determined by a refrigerant collection determination unit 105, and the control of each apparatus during refrigerant collection operation is carried out by a refrigerant collection controller 106. In addition, a time measurement unit 107 that measures the elapsed time from the end of the previous refrigerant collection operation up to the present is included.

The above measurement unit 102, normal operation controller 103, refrigerant collection determination unit 105, refrigerant collection controller 106, and time measurement unit 107 are realized by a microcontroller, while the storage unit 104 is realized by semiconductor memory or the like. The controller 101 is placed in the heat source unit 301, but this is merely one example, and the placement location is not limited. Also, through the remote control (not illustrated), a user is able to select cooling on-off, heating on-off, and hot water supply on-off, and is also able to input an indoor set temperature and the boiling temperature.

<Cooling and Hot Water Supply Simultaneous Operating Mode A>

The refrigeration cycle apparatus 100 is able to perform a cooling and hot water supply simultaneous operating mode A by the control of each apparatus when a cooling load in the indoor unit 302 and a hot water supply demand in the hot water supply unit 303 are produced at the same time.

In the cooling and hot water supply simultaneous operating mode A, the four-way valve 12 connects the inlet side of the compressor 1 to the gas side of the indoor side heat exchanger 9. Also, the discharge solenoid valve 2*a* closes, the discharge solenoid valve 2*b* opens, and the solenoid valve 16 opens. Note that the opening degree of the hot water supply side pressure-reducing mechanism 6 is controlled to be fixed at the maximum opening degree, while the heat source side pressure-reducing mechanism 13 is controlled to be fixed at the minimum opening degree.

High temperature and high pressure gas refrigerant discharged from the compressor 1 flows into the discharge solenoid valve 2*b*, and flows into the water side heat exchanger 4 via the water side gas extension pipe 3. In the water side heat exchanger 4, refrigerant heats water medium supplied by the water pump 18 to become high pressure liquid refrigerant, and flows out from the water side heat exchanger 4. After that, the high pressure liquid refrigerant passes via the water side liquid extension pipe 5 through the hot water supply side pressure-reducing mechanism 6 fixed at the fully-open opening degree, flows into the indoor side pressure-reducing mechanism 7, and is depressurized to become a low pressure two-phase refrigerant. At this time, the indoor side pressure-reducing mechanism 7 is controlled so that the degree of subcooling on the liquid side of the water side heat exchanger 4 becomes a designated value. The degree of subcooling on the liquid side of the water side heat exchanger 4 is computed by subtracting the temperature detected by the temperature sensor 205 from the saturation temperature of the pressure at the pressure sensor 201. The low pressure two-phase refrigerant, after passing through the indoor side pressure-reducing mechanism 7, flows into the indoor side heat exchanger 9 via the indoor side liquid extension pipe 8, and cools the indoor air supplied by the indoor side blower 10 to become a low pressure gas refrigerant. After that, refrigerant flowing out of the indoor side heat exchanger 9 passes through the four-way valve 12 via the indoor side gas extension pipe 11, and then passes through the accumulator 17, and is suctioned into the compressor 1 again. The frequency of the compressor 1 is decided according to the temperature difference between the indoor temperature detected by the temperature sensor 204 and the indoor set temperature, and in addition, the rotation speed of the heat source side blower 15 is decided according to the outdoor air temperature detected by the temperature sensor 207.

Note that since the heat source side pressure-reducing mechanism 13 is at the minimum opening degree and the solenoid valve 16 is open, refrigerant present in the heat source side heat exchanger 14 is in a low pressure environment, and enters a low pressure gas state. Also, since the water side heat exchanger 4 is connected to the discharge part of the compressor 1 in parallel with the four-way valve 12, waste heat produced by the cooling in the indoor side heat exchanger 9 may be collected in the water side heat exchanger 4.

In the refrigeration cycle apparatus 100, besides the cooling and hot water supply simultaneous operating mode A, a cooling operating mode B conducted when there is no hot water supply demand in the hot water supply unit 303 and only a cooling load in the indoor unit 302 may be performed, and a heating operating mode C conducted when there is no hot water supply demand in the hot water supply unit 303 and only a heating load in the indoor unit 302 may be performed. Also, a hot water supply operating mode D conducted when there is no air conditioning load in the indoor unit 302 and only a hot water supply demand in the hot water supply unit 303 may also be performed.

<Cooling Operating Mode B>

Hereinafter, normal operation control of each apparatus, the direction of refrigerant flow, and the refrigerant state in the cooling operating mode B will be described. Note that normal operation control is performed by the normal operation controller 103. In the cooling operating mode B, the four-way valve 12 connects the discharge side of the compressor 1 to the gas side of the heat source side heat exchanger 14, and connects the suction side to the indoor side heat exchanger 9. Also, the discharge solenoid valve 2*a* opens, the discharge solenoid valve 2*b* closes, and the solenoid valve 16 closes. Furthermore, the hot water supply side pressure-reducing mechanism 6 is controlled to a minimum opening degree (fully-closed opening degree), while the heat source side pressure-reducing mechanism 13 is controlled to a maximum opening degree (fully-open opening degree).

The high temperature and high pressure gas refrigerant discharged from the compressor 1 flows into the heat source side heat exchanger 14 via the discharge solenoid valve 2*a* and the four-way valve 12, and exchanges heat with outdoor air supplied by the heat source side blower 15 to become a high pressure liquid refrigerant. After that, the high pressure liquid refrigerant flows out of the heat source side pressure-reducing mechanism 13, and is depressurized by the indoor side pressure-reducing mechanism 7 to become a low pressure two-phase refrigerant. At this time, the indoor side pressure-reducing mechanism 7 is controlled so that the degree of subcooling on the liquid side of the heat source side heat exchanger 14 becomes a designated value. The degree of subcooling on the liquid side of the heat source side heat exchanger 14 is computed by subtracting the temperature at the temperature sensor 206 from the saturation temperature of the pressure at the pressure sensor 201. The low pressure two-phase refrigerant, after passing through the indoor side pressure-reducing mechanism 7, flows into the indoor side heat exchanger 9 via the indoor side liquid extension pipe 8, and cools the indoor air supplied by the indoor side blower 10 to become a low pressure gas refrigerant. After that, refrigerant exiting the indoor side heat exchanger 9 passes through the four-way valve 12 via the indoor side gas extension pipe 11, and after flowing out of the accumulator 17, is suctioned into the compressor 1 again. Note that the frequency of the compressor 1 is decided according to the temperature difference between the indoor temperature and the indoor set temperature, and in addition, the rotation speed of the heat source side blower 15 is decided according to the outdoor air temperature.

In the normal operation control of the cooling operating mode B, the discharge solenoid valve 2*b* is closed and the hot water supply side pressure-reducing mechanism 6 is at a minimum opening degree, but since refrigerant still flows along the flow channel of the hot water supply unit 303 in small amounts from structural gaps and the like, refrigerant condenses in the hot water supply refrigerant flow channel made up of the water side heat exchanger 4, the water side gas extension pipe 3, and the water side liquid extension pipe 5, and over the time of operation, refrigerant accumulates in the hot water supply refrigerant flow channel. For this reason, it is necessary to detect refrigerant accumulation in the hot water supply refrigerant flow channel, and collect accumulated refrigerant in the hot water supply refrigerant flow channel into the cooling main flow channel of the refrigerant circuit. Herein, the cooling main flow channel refers to the flow channel described earlier, which flows from the compressor 1 to the discharge solenoid valve 2*a*, the heat source side heat exchanger 14, the indoor side pressure-reducing mechanism 7, the indoor side heat exchanger 9, the accumulator 17, and the compressor 1. In an ordinary refrigeration cycle apparatus that switches between cooling and heating in which a heat exchanger is connected via the four-way valve 12, even if several indoor units are stopped during cooling operation, the heat exchanger is a low pressure environment, and thus refrigerant does not accumulate, and a refrigerant collecting operation is unnecessary. However, with the refrigeration cycle apparatus 100 illustrated in Embodiment 1, since the water side heat exchanger 4 is connected in parallel with the four-way valve 12, refrigerant in the water side heat exchanger 4 and its connecting pipes is in a high pressure environment during cooling operation, and the refrigerant accumulates. For this reason, a refrigerant collecting operation becomes necessary.

If the refrigerant amount in the cooling main flow channel is insufficient, the low-pressure side pressure decreases, and the refrigerant temperature on the low-pressure side decreases. Thus, by detecting this state, the need for refrigerant collection may be determined. Specifically, since refrigerant becomes a low pressure two-phase refrigerant from the indoor side pressure-reducing mechanism 7 to the liquid side of the indoor side heat exchanger 9, and the refrigerant temperature corresponds to the saturation temperature of the low-pressure side pressure, the decrease in the low-pressure side pressure may be detected by measuring the refrigerant temperature at some position therebetween. In the refrigeration cycle apparatus 100, when the refrigerant temperature detected by the temperature sensor 203 positioned on the liquid side of the indoor side heat exchanger 9 becomes less than or equal to a cooling refrigerant collection start temperature (set to 4 degrees C., for example) stored in the storage unit 104, the refrigerant collection determination unit 105 determines the start of the refrigerant collecting operation, and the refrigerant collection controller 106 performs the action of the cooling refrigerant collecting operation. Herein, the temperature sensor 203 corresponds to a low pressure refrigerant temperature detecting unit in the cooling operating mode B of the refrigeration cycle apparatus 100.

Figure 3:
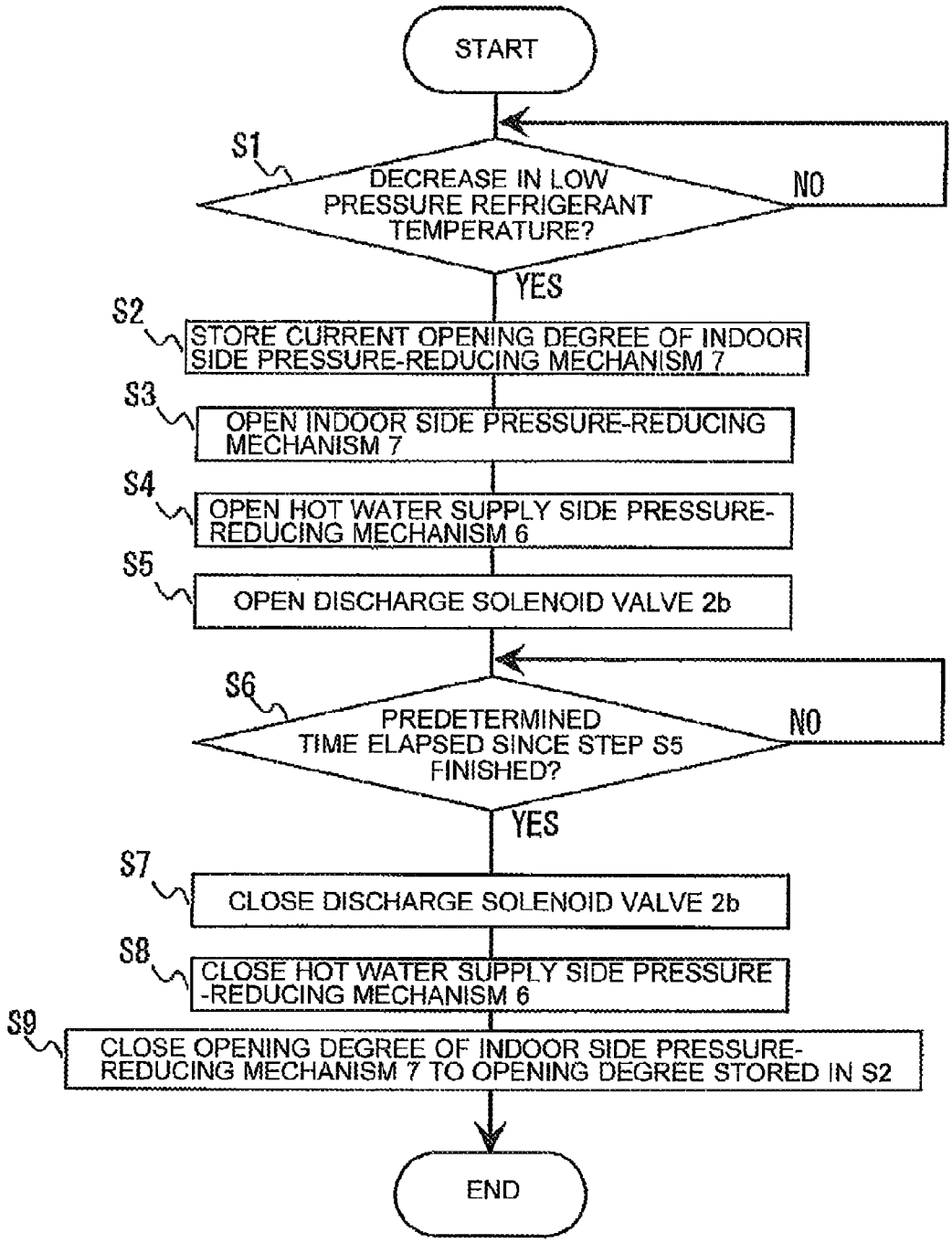
FIG. 3 is a flowchart illustrating an operating procedure of cooling refrigerant collecting operation in a cooling operating mode B of a refrigeration cycle apparatus 100.

The flowchart illustrated in FIG. 3 will be used to describe a method of operation of the cooling refrigerant collecting operation. In step S1, if a decrease in the saturation temperature of the low pressure refrigerant is detected, the refrigerant collection determination unit 105 determines to start cooling refrigerant collection, and the refrigerant collection controller 106 performs the action of the refrigerant collecting operation in the subsequent steps. Note that step S1 becomes YES when the saturation temperature of the low pressure refrigerant decreases to less than or equal to the cooling refrigerant collection start temperature. First, in step S2, the current opening degree of the indoor side pressure-reducing mechanism 7 is stored in the storage unit 104. After that, the indoor side pressure-reducing mechanism 7 is opened in step S3. After that, the hot water supply side pressure-reducing mechanism 6 is opened in step S4, and the discharge solenoid valve 2*b* is opened in step S5. By opening the hot water supply side pressure-reducing mechanism 6 and the discharge solenoid valve 2*b*, the refrigerant discharged from the compressor 1 divides into refrigerant that flows through the discharge solenoid valve 2*a* and refrigerant that flows through the discharge solenoid valve 2*b*, and the refrigerant that flows through the discharge solenoid valve 2*b* is able to pass through the hot water supply flow channel. For this reason, refrigerant accumulated in the hot water supply flow channel may be pushed out into the cooling main flow channel and collected. Note that the reason for also opening the indoor side pressure-reducing mechanism 7 is because during the cooling refrigerant collecting operation, the installation position of the indoor side pressure-reducing mechanism 7 is positioned downstream of the hot water supply flow channel, and if the opening degree of the indoor side pressure-reducing mechanism 7 is small, accumulated refrigerant in the hot water supply flow channel may not be pushed out with normal control in the cooling operating mode B. The opening degrees when opening the indoor side pressure-reducing mechanism 7 and the hot water supply side pressure-reducing mechanism 6 are fixed to fully-open opening degrees, for example. Also, unlike the refrigeration cycle apparatus 100 of Embodiment 1, step S5 is unnecessary for a separate refrigeration cycle apparatus without a discharge solenoid valve 2*b* on the discharge side of the compressor. In this case, in step S6 it is determined whether or not a predetermined time has elapsed since step S4 finished. Also, the operating frequency of the compressor 1 and the rotation speed of the heat source side blower 15 are kept fixed at the operating frequency and the rotation speed from the time when step S1 became YES. Additionally, the opening degree of the heat source side pressure-reducing mechanism 13 is also kept fixed at the maximum opening degree.

Next, in step S6, it is determined whether or not a predetermined time (for example, 1 minute) has elapsed since step S5 finished. The elapsed time herein corresponds to a refrigerant collecting time during which to collect refrigerant from the hot water supply flow channel, and is a set time stored in the storage unit 104. After the predetermined time elapses, the discharge solenoid valve 2*b* is closed in step S7, and the hot water supply side pressure-reducing mechanism 6 is closed in step S8. Finally, in step S9, the opening degree of the indoor side pressure-reducing mechanism 7 is set to the opening degree that was stored in step S2, the cooling refrigerant collecting operation is ended, and the process proceeds to the normal control in cooling operating mode B.

Herein, in step S4, since the discharge solenoid valve 2*b* is opened after the hot water supply side pressure-reducing mechanism 6 is opened, at the time when refrigerant starts to flow to the hot water supply unit 303, the hot water supply flow channel outlet is in a state allowing refrigerant to flow towards the cooling main flow channel, and in a state with no possibility of a high pressure cutoff due to refrigerant flow being closed off. Also, in step S7, since the discharge solenoid valve 2*b* is closed before the hot water supply side pressure-reducing mechanism 6 closes, an inability for refrigerant flowing through the hot water supply flow channel to flow to the cooling main flow channel and the possibility of a high pressure cutoff may be avoided.

By configuring the operating procedure of the discharge solenoid valve like the flowchart in FIG. 3, a highly reliable method of operation may be carried out without abnormal stops by high pressure cutoff during the refrigerant collecting operation.

Also, if the solenoid valve is made to operate in a state of a high refrigerant flow rate in the cooling main flow channel, the refrigerant flow rate in the solenoid valve part increases suddenly, producing refrigerant noise or vibration. Lowering the operating frequency of the compressor 1 before the solenoid valves operate is effective at moderating increases in refrigerant noise and vibration. In the case of lowering the operating frequency, in step S2, the current operating frequency of the compressor 1 is made to be stored. In step S4, after opening the hot water supply side pressure-reducing mechanism 6, the operating frequency of the compressor 1 is lowered to a designated value set as a solenoid valve switching frequency (for example, approximately 30 Hz). In so doing, the occurrence of refrigerant noise and vibration during solenoid value operation may be moderated. Note that the solenoid valve switching frequency is a value lower than the startup operating frequency (for example, 30 Hz), which is the maximum value of the compressor frequency over one minute from the beginning of the startup of normal control (the operating frequency of the compressor 1 rising from 0).

Step S6 may be performed with the operating frequency of the compressor 1 kept low, but if the operating frequency of the compressor 1 is low, the refrigerant flow rate discharged from the compressor 1 is small, and thus the refrigerant flow rate flowing to the hot water supply flow channel also becomes small, and cases in which accumulated refrigerant is not sufficiently pushed out are conceivable. For this reason, in step S5, after opening the discharge solenoid valve 2*b*, the operating frequency of the compressor 1 is raised to the solenoid valve switching frequency or more, specifically the operating frequency of the compressor 1 immediately before the start of refrigerant collection (for example, 70 Hz), that was stored in the storage unit 104 in step S2, for example. In so doing, refrigerant accumulated in the hot water supply flow channel may be pushed out sufficiently. Obviously, even if the operating frequency of the compressor 1 is not lowered when opening the hot water supply side pressure-reducing mechanism 6, but the operating frequency of the compressor 1 has been lowered as part of normal operation, an action of raising the operating frequency to a designated value may also be performed. After step S6 ends, in step S7, the discharge solenoid valve 2*b* is closed after switching the operating frequency of the compressor 1 to the solenoid valve switching frequency, and after performing step S9, the operating frequency of the compressor 1 is restored to the frequency that was stored in step S2, and normal operation control is performed.

As refrigerant accumulation in the hot water supply flow channel proceeds, the temperature of the low pressure refrigerant flowing through the indoor side heat exchanger 9 decreases, and if refrigerant accumulation proceeds further, the low pressure refrigerant temperature becomes 0 degrees C. or less. If operation is continued in this state, the water component included in the indoor air will freeze to (form frost on) the indoor side heat exchanger 9, not only causing a sudden decrease in cooling capacity due to obstruction of the air channel, but also becoming a target of complaints from users as the frost melts after operation stops to produce dew formation and dripping. To prevent freezing of the indoor side heat exchanger 9, ordinarily, the normal operation controller 103 is equipped with a freeze protection control. With the freeze protection control, if the temperature of refrigerant flowing through the indoor side heat exchanger 9 decreases (for example, becomes 2 degrees C. or less), an action of stopping the operation of the compressor 1 is performed. If the compressor 1 is stopped by the freeze protection control, operation of the refrigeration cycle apparatus 100 is restarted, which not only lengthens the time taken to cool the air, but also lowers operating efficiency due to going through the startup state. For this reason, it is necessary to perform the cooling refrigerant collecting operation before the low pressure refrigerant temperature decreases enough to trigger the freeze protection control.

Figure 4:
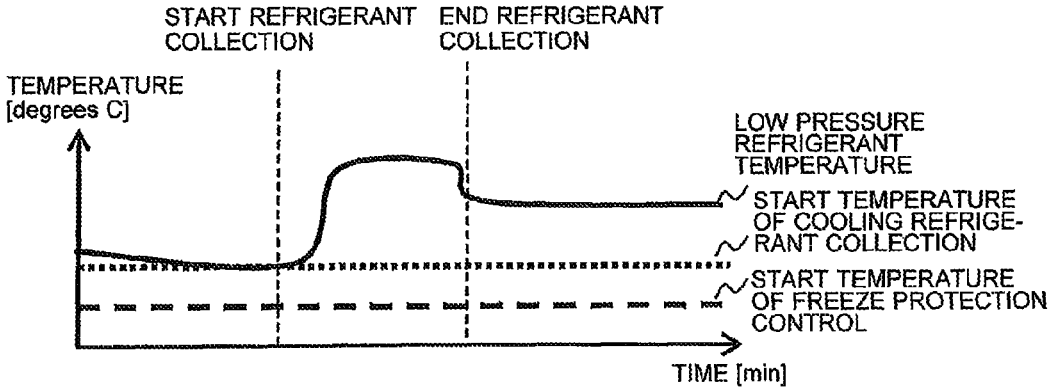
FIG. 4 is a schematic diagram illustrating a relationship between a start determination temperature of a freeze protection control and a start temperature of cooling refrigerant collecting operation in a cooling operating mode B of a refrigeration cycle apparatus 100.

FIG. 4 is a schematic diagram illustrating a relationship between the start temperature of cooling refrigerant collecting operation and a start determination temperature of the low pressure refrigerant temperature for freeze protection control in the refrigeration cycle apparatus 100. In the refrigeration cycle apparatus 100, the cooling refrigerant collection start temperature is set higher than the start determination temperature of the freeze protection control, and thus when the low pressure refrigerant temperature decreases, the cooling refrigerant collecting operation is performed before the freeze protection control starts. For this reason, the triggering of freeze protection in response to a low-pressure decrease by refrigerant accumulation in the hot water supply unit 303 may be prevented. Also, it becomes possible to distinguish a decrease in low pressure refrigerant temperature due to a decrease in outdoor air temperature and indoor temperature, which not only enables more suitable determination of the need for refrigerant collecting operation, but also avoids decreases in operating efficiency by not going through a startup state.

Furthermore, if the start temperature of the cooling refrigerant collecting operation is simply set higher than the start temperature of the freeze protection control, when the low pressure refrigerant temperature decreases because of an extremely low indoor temperature or outdoor air temperature, or when the low pressure refrigerant temperature decreases because of insufficient refrigerant due to a refrigerant leak, the cooling refrigerant collecting operation will be repeatedly performed even though refrigerant is not accumulated in the hot water supply flow channel, and the operating behavior will become extremely unstable. For this reason, the time measurement unit 107 may measure the time, and a refrigerant collecting operation prohibited time may be created in which the cooling refrigerant collecting operation is not performed within a refrigerant collection prohibited time starting from the previous cooling refrigerant collecting operation. The refrigerant collection prohibited time in the cooling operating mode B is set to 20 minutes, for example. The time measurement unit 107 measures the time from the end of the previous refrigerant collecting operation (after the end of step S9 in FIG. 3) up to the present time, and after the end of the next refrigerant collecting operation, clears (sets to zero) the measured time, and starts the time measurement again. According to this configuration, the freeze protection control may be performed within the refrigerant collecting operation prohibited time, a low-pressure decrease occurring when refrigerant is not accumulated in the hot water supply unit 303, such as when the indoor temperature is extremely low, may be processed appropriately, and operating stability is improved.

It is also possible to perform the refrigerant collecting operation by setting a fixed threshold value of the low pressure refrigerant temperature in the cooling refrigerant collecting operation start determination, but when the indoor air temperature is high, the low pressure refrigerant temperature for normal refrigerant quantities in the cooling main flow channel is also high, and thus the cooling refrigerant collecting operation is not started unless the low pressure refrigerant temperature decreases greatly. If the low pressure refrigerant temperature decreases greatly from normal, since the indoor air temperature is high, the degree of superheat in the indoor side heat exchanger 9 increases, and as a result, dew formation and dew flying occur in the indoor unit 302, possibly impairing user comfort.

Figure 5:
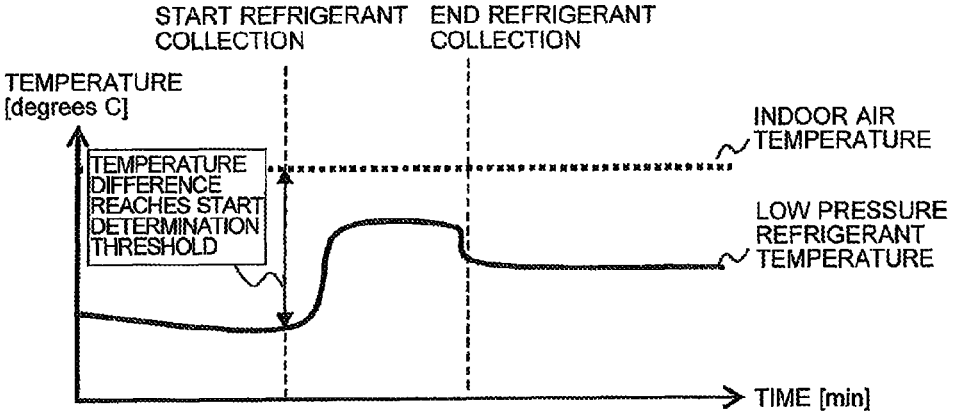
FIG. 5 is a schematic diagram illustrating a start determination of cooling refrigerant collecting operation according to a temperature difference between an indoor air temperature and a low-pressure refrigerant temperature in a cooling operating mode B of a refrigeration cycle apparatus 100.

For this reason, as illustrated in FIG. 5, the cooling refrigerant collecting operation is made to be performed when the low pressure refrigerant temperature decreases, until the temperature difference between the indoor air temperature and the low pressure refrigerant temperature becomes equal to or greater than a cooling refrigerant collection start temperature difference (for example, equal to or greater than 18 degrees C.). Note that the indoor air temperature refers to the air temperature detected by the temperature sensor 204. In so doing, when the indoor air temperature is high, the cooling refrigerant collecting operation may be performed before the refrigerant amount in the cooling main flow channel becomes insufficient as the low pressure refrigerant temperature decreases greatly from normal, and thus an increase in the degree of superheat in the indoor side heat exchanger 9 may be avoided, and a state of impaired user comfort due to dew formation and dew flying may be avoided. Note that the determination corresponding to step S1 in FIG. 3 becomes YES when the low pressure refrigerant temperature decreases to become equal to or greater than the cooling refrigerant collection start temperature difference.

Figure 6:
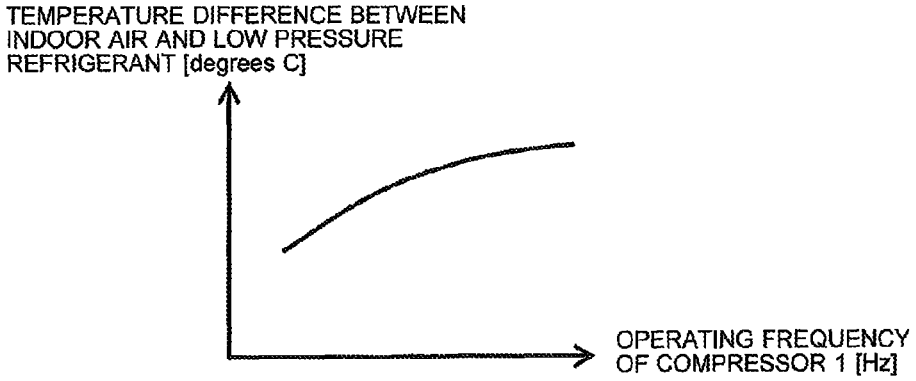
FIG. 6 is a schematic diagram illustrating change in a temperature difference between indoor air and low-pressure refrigerant versus the operating frequency of a compressor 1 during a normal refrigerant flow rate in a cooling main flow channel in a cooling operating mode B of a refrigeration cycle apparatus 100.

FIG. 6 is a schematic diagram illustrating change in a temperature difference between indoor air and low-pressure refrigerant versus the operating frequency of the compressor 1. Since the indoor air is cooled to the extent that the operating frequency of the compressor 1 is high, the temperature difference between the indoor air and the low pressure refrigerant changes depending on the operating frequency of the compressor 1. For this reason, a correlation equation that computes the cooling refrigerant collection start temperature difference from the operating frequency of the compressor 1 may be stored in the storage unit 104, and during normal operation, the cooling refrigerant collection start temperature difference may be computed from the operating frequency of the compressor 1, and used in a start determination for the refrigerant collecting operation. Thus, even if the temperature difference between the indoor air and the low pressure refrigerant is small because the cooling load is small and the operating frequency of the compressor 1 is low, the cooling refrigerant collecting operation may be performed before the refrigerant amount in the cooling main flow channel becomes insufficient as the low pressure refrigerant temperature decreases greatly from normal, and thus an increase in the degree of superheat in the indoor side heat exchanger 9 may be avoided, and a state of impaired user comfort due to dew formation and dew flying may be avoided.

The opening degree of the heat source side pressure-reducing mechanism 13 is kept fixed at the maximum opening degree during the cooling refrigerant collecting operation, but in the flowchart of FIG. 3, because the indoor side pressure-reducing mechanism 7 installed in the cooling main flow channel is opened, the refrigerant distributed in the heat source side heat exchanger 14 also flows to the low pressure side of the cooling main flow channel, and a large amount of refrigerant flows to the accumulator 17. If the amount of liquid in the accumulator 17 increases, liquid of refrigerant may advance into the suction part of the compressor 1, thereby causing the suction part of the compressor 1 to become damp, and possibly causing malfunction due to a decrease in the oil concentration in the compressor 1. It is necessary to adjust the opening degree of the pressure-reducing mechanism installed in the cooling main flow channel so that refrigerant in the heat source side heat exchanger 14, which acts as a condenser during the refrigerant collecting operation, does not flow to the low pressure side.

Figure 7:
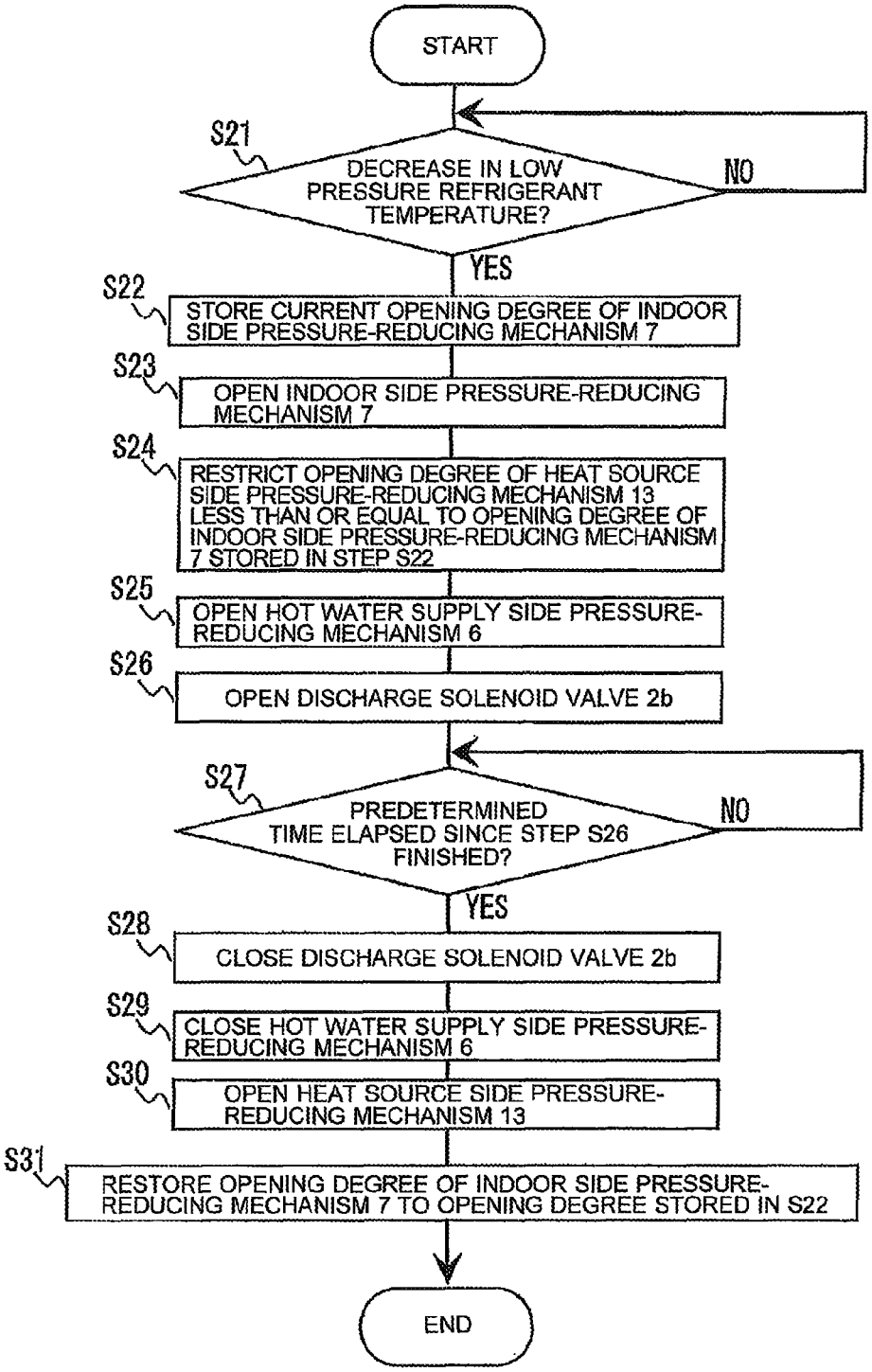
FIG. 7 is a flowchart illustrating an operating procedure of cooling refrigerant collecting operation in a case of closing a heat source side pressure-reducing mechanism 13 in a cooling operating mode B of a refrigeration cycle apparatus 100.

In the refrigeration cycle apparatus 100, during the cooling refrigerant collecting operation, the refrigerant in the heat source side heat exchanger 14 is made not to flow by restricting the heat source side pressure-reducing mechanism 13, which is not positioned on the downstream side of the hot water supply flow channel, and through which refrigerant flowing through the hot water supply flow channel does not pass. FIG. 7 illustrates a flowchart of a method of operation at this time. After detecting a decrease in the saturation temperature of the low pressure refrigerant in step S21, the opening degree of the indoor side pressure-reducing mechanism 7 immediately before the start of refrigerant collection is stored in the storage unit 104 in step S22, and the indoor side pressure-reducing mechanism 7 is opened to the maximum opening degree, for example, in step S23. After that, in step S24, the heat source side pressure-reducing mechanism 13 is restricted to be less than or equal to the opening degree of the indoor side pressure-reducing mechanism 7 that was stored in step S22. In other words, by setting the heat source side pressure-reducing mechanism 13 to approximately the opening degree of the indoor side pressure-reducing mechanism 7, the restriction of the cooling main flow channel immediately before the start of refrigerant collection may be secured, and thus the flow of a large amount of refrigerant distributed in the heat source side heat exchanger 14 is prevented. In addition, during the cooling refrigerant collecting operation, since the refrigerant discharged from the compressor 1 is divided into refrigerant flowing through the discharge solenoid valve 2*a* and refrigerant flowing through the discharge solenoid valve 2*b*, the flow rate of refrigerant passing through the heat source side heat exchanger 14 and the heat source side pressure-reducing mechanism 13 decreases compared to that of the cooling operating mode B. For this reason, the opening degree of the heat source side pressure-reducing mechanism is adjusted to be less than or equal to the opening degree of the indoor side pressure-reducing mechanism 7 immediately before the start of refrigerant collection. In so doing, during the cooling refrigerant collecting operation, the operating state securing the degree of subcooling on the liquid side of the heat source side heat exchanger 14 that functions as the condenser in the cooling operating mode B is maintained, or in other words, the outlet refrigerant temperature of the heat source side heat exchanger 14 becomes less than the refrigerant saturation temperature on the high pressure side, and changes in the refrigerant amount distributed in the heat source side heat exchanger 14 may be moderated. Note that the refrigerant saturation temperature on the high pressure side is the saturation temperature of the detected pressure from the pressure sensor 201, but is not limited thereto. A temperature may also be installed in a heat transfer pipe of the heat source side heat exchanger 14, and the detected temperature may also be used. In addition, the outlet refrigerant of the heat source side heat exchanger 14 refers to the refrigerant positioned between the heat source side heat exchanger 14 and the heat source side pressure-reducing mechanism 13.

Next, the hot water supply side pressure-reducing mechanism 6 is opened in step S25, the discharge solenoid valve 2*b* is opened in step S26, and upon determining that a predetermined time has elapsed in step S27, the discharge solenoid valve 2*b* is closed in step S28. Since the heat source side pressure-reducing mechanism 13 is restricted to perform refrigerant collection, at the time when the predetermined time has elapsed in step S27, the operating state is such that the degree of subcooling on the liquid side of the water side heat exchanger 4 is zero, or in other words, the output refrigerant temperature of the water side heat exchanger 4 becomes equal to or greater than the refrigerant saturation temperature on the high pressure side, and the refrigerant state becomes two-phase or gas, while in addition, the degree of subcooling on the liquid side of the heat source side heat exchanger 14 is greater than zero, or in other words, the outlet refrigerant temperature of the heat source side heat exchanger 14 becomes less than the refrigerant saturation temperature on the high pressure side, and the refrigerant state becomes liquid. Specifically, accumulated refrigerant in the hot water supply flow channel may be collected sufficiently, while in addition, liquid refrigerant may be retained in the heat source side heat exchanger 14. Herein, the outlet refrigerant on the water side heat exchanger 4 refers to the refrigerant positioned between the water side heat exchanger 4 and the hot water supply side pressure-reducing mechanism 6. After closing the discharge solenoid valve 2*b*, in step S29 the hot water supply side pressure-reducing mechanism 6 is closed, in step S30 the heat source side pressure-reducing mechanism 13 is opened to the maximum opening degree, and in step S31 the opening degree of the indoor side pressure-reducing mechanism 7 is restored to the opening degree immediately before the start of refrigerant collection.

As above, during the cooling refrigerant collecting operation, the opening degree of the heat source side pressure-reducing mechanism 13 is restricted and the hot water supply side pressure-reducing mechanism 6 is also opened, and thus the operating state becomes such that the degree of subcooling on the liquid side of the water side heat exchanger 4 is zero, and in addition, the degree of subcooling on the liquid side of the heat source side heat exchanger 14 is greater than zero. For this reason, a large amount of refrigerant no longer flows to the accumulator 17 or the compressor 1, the oil concentration in the compressor 1 no longer decreases, and device reliability is improved. Furthermore, since the cooling refrigerant collecting operation ends in a state with liquid refrigerant distributed in the heat source side heat exchanger 14, in the resumed cooling operation, the ramp-up in cooling performance is extremely fast, and user comfort is improved.

Note that if the operating frequency of the compressor 1 changes between immediately before the start of cooling refrigerant collection and during the cooling refrigerant collecting operation, the opening degree of the heat source side pressure-reducing mechanism 13 is adjusted in correspondence with the ratio of the change. For example, if the operating frequency of the compressor 1 is 30 Hz immediately before starting, and 60 Hz during the collecting operation, when the opening degree of the indoor side pressure-reducing mechanism 7 immediately before refrigerant collection is 110 pulses, the opening degree of the heat source side pressure-reducing mechanism 13 during the collecting operation is set to 110*60/30=220 pulses. In so doing, a high pressure cutoff during the refrigerant collecting operation due to an increase in the operating frequency of the compressor 1 may be avoided.

Also, in the cooling operating mode B, the discharge solenoid valve 2*b* is closed and the hot water supply side pressure-reducing mechanism 6 is set to the minimum opening degree to create a state in which refrigerant does not circulate through the hot water supply refrigerant circuit. On the other hand, for an embodiment without the discharge solenoid valve 2*b*, in the hot water supply refrigerant circuit, in order to create an operating state in which the heating amount of the water side heat exchanger 4 is decreased while the accumulated refrigerant amount is also reduced as much as possible, ordinarily the hot water supply side pressure-reducing mechanism 6 is opened slightly to cause operation in which a small amount of refrigerant circulates through the hot water supply circuit. In the case of this operation, refrigerant still accumulates in the hot water supply refrigerant circuit depending on environmental factors such as the indoor temperature and the water temperature. By applying the present technique, it becomes possible to appropriately collect refrigerant accumulated in the hot water supply circuit, even for a method of operation in which refrigerant circulates through the hot water supply circuit.

<Heating Operating Mode C>

In the normal operation control of the heating operating mode C, the four-way valve 12 connects the discharge side of the compressor 1 to the gas side of the indoor side heat exchanger 9, and connects the suction side to the gas side of the heat source side heat exchanger 14. Also, the discharge solenoid valve 2*a* opens, the discharge solenoid valve 2*b* closes, and the solenoid valve 16 closes. Furthermore, the hot water supply side pressure-reducing mechanism 6 is fixed at the minimum opening degree, while the indoor side pressure-reducing mechanism 7 is fixed at the maximum opening degree.

High temperature and high pressure gas refrigerant discharged from the compressor 1 flows to the indoor side gas extension pipe 11 via the discharge solenoid valve 2*a* and the four-way valve 12. After that, the refrigerant flows into the indoor side heat exchanger 9, and heats indoor air supplied by the indoor side blower 10 to become high pressure liquid refrigerant. After that, the high pressure liquid refrigerant flows out of the indoor side heat exchanger 9. After that, the high pressure liquid refrigerant flows out from the indoor unit 302, and after passing through the indoor side pressure-reducing mechanism 7 via the indoor side liquid extension pipe 8, is depressurized by the heat source side pressure-reducing mechanism 13 to become low pressure two-phase refrigerant. At this point, the heat source side pressure-reducing mechanism 13 is controlled so that the degree of subcooling in the indoor side heat exchanger 9 becomes a designated value. The degree of subcooling in the indoor side heat exchanger 9 is computed by subtracting the temperature at the temperature sensor 203 from the saturation temperature of the pressure at the pressure sensor 201. The low pressure two-phase refrigerant, after passing through the heat source side pressure-reducing mechanism 13, flows into the heat source side heat exchanger 14, and exchanges heat with outdoor air supplied by the heat source side blower 15 to become low pressure gas refrigerant. The low pressure gas refrigerant, after flowing out from the heat source side heat exchanger 14, passes through the accumulator 17 via the four-way valve 12, and is suctioned into the compressor 1 again. Note that the frequency of the compressor 1 is decided according to the temperature difference between the indoor temperature and the indoor set temperature, and in addition, the rotation speed of the heat source side blower 15 is decided according to the outside air temperature.

In the normal operation control of the heating operating mode B, the discharge solenoid valve 2*b* is closed and the hot water supply side pressure-reducing mechanism 6 is at a minimum opening degree, but since refrigerant still flows along the hot water supply flow channel in small amounts from mechanical gaps and the like, over the time of operation, refrigerant accumulates in the hot water supply flow channel. For this reason, it is necessary to detect refrigerant accumulation in the hot water supply flow channel, and collect the accumulated refrigerant into the heating main flow channel of the refrigerant circuit. Herein, the heating main flow channel refers to the flow channel described earlier, which flows from the compressor 1 to the discharge solenoid valve 2*a*, the indoor side heat exchanger 9, the indoor side pressure-reducing mechanism 7, the heat source side heat exchanger 14, the accumulator 17, and the compressor 1.

Even in an ordinary refrigeration cycle apparatus that switches between cooling and heating in which a heat exchanger is connected via the four-way valve 12, when several of the indoor units are stopped during heating operation, the heat exchanger is a high pressure environment, and thus refrigerant accumulates, and the refrigerant collecting operation becomes necessary. If refrigerant becomes insufficient in the heating main flow channel, the low-pressure side pressure decreases, but since the low-pressure side pressure also decreases from the frosting phenomenon in heat source side heat exchanger 14, ordinarily, a defrosting operating mode E starts when the low-pressure side pressure decreases during heating operation. Ordinarily, a defrosting start determination is established and operation proceeds to defrosting operation upon detecting that the low pressure refrigerant temperature has decreased to a defrosting start temperature or less (for example, 5 degrees C. or less) for a predetermined time or more (for example, a continuous 7 minutes or more).

At this point, the operating state in the defrosting operating mode E will be described. In the defrosting operating mode E, the four-way valve 12 connects the discharge side of the compressor 1 to the gas side of the heat source side heat exchanger 14, and connects the suction side to the gas side of the indoor side heat exchanger 9. Also, the discharge solenoid valve 2*a* opens, the discharge solenoid valve 2*b* closes, and the solenoid valve 16 closes. Furthermore, the hot water supply side pressure-reducing mechanism 6 is fixed at the minimum opening degree, while the indoor side pressure-reducing mechanism 7 and the heat source side pressure-reducing mechanism 13 are fixed at the maximum opening degree. Also, the operating frequency of the compressor 1 is a constant value, and the heat source side blower 15 is stopped. The high temperature and high pressure gas refrigerant discharged from the compressor 1 flows to the heat source side heat exchanger 14 via the discharge solenoid valve 2*a* and the four-way valve 12, and melts frost adhering to the fins to become liquid refrigerant. After that, the refrigerant flows to the indoor side heat exchanger 9 via the heat source side pressure-reducing mechanism 13, the indoor side pressure-reducing mechanism 7, and the indoor side liquid extension pipe 8. After that, the refrigerant passes through the indoor side gas extension pipe 11, the four-way valve 12, and the accumulator 17, and is suctioned into the compressor 1 again.

In the defrosting operating mode E, the heat source side heat exchanger 14 becomes a high pressure environment, and thus the defrosting of the heat source side heat exchanger 14 becomes possible. As defrosting proceeds, the high-pressure side pressure rises, because the heat source side blower 15 is stopped. For this reason, the defrosting operating mode E ends when the high-pressure side pressure detected by the pressure sensor 201 becomes equal to or greater than a designated value (for example, equal to or greater than a pressure corresponding to a condensing temperature of 45 degrees C.). When the outdoor air temperature is low (for example, −15 degrees C.), the low pressure refrigerant temperature becomes less than or equal to the defrosting start temperature, irrespectively of the frosting of the heat source side heat exchanger 14. For this reason, during a defrosting prohibited time (for example, 60 minutes) from the end of the previous defrosting, operation is made to not proceed to the defrosting operating mode E even if the low pressure refrigerant temperature becomes less than or equal to the defrosting start temperature. The time measurement unit 107 measures the time from the end of the previous defrosting operation up to the present time, and after the end of the next defrosting operation, clears the measured time and starts the time measurement again.

In the defrosting operating mode E, since the refrigerant in the indoor side heat exchanger 9 is in a low pressure environment, in an ordinary refrigeration cycle apparatus that switches between cooling and heating in which a heat exchanger is connected via the four-way valve 12, proceeding to the defrosting operating mode E causes refrigerant accumulated in the stopped indoor unit 302 and joining pipe to evaporate or flow towards the suction part of the compressor 1, enabling easy collection of accumulated refrigerant. However, with the refrigeration cycle apparatus 100 illustrated in Embodiment 1, the water side heat exchanger 4 is connected in parallel with the four-way valve 12, and refrigerant in the water side heat exchanger 4 and the connecting pipe remains in a high pressure environment. Thus, even if the defrosting operating mode E is performed, accumulated refrigerant in the hot water supply flow channel is not collected into the heating main flow channel. For this reason, a refrigerant collecting operation for the collection of accumulated refrigerant in the hot water supply flow channel, unrelated to performing the defrosting operating mode E, becomes necessary.

For the start determination of heating refrigerant collecting operation, which is the refrigerant collecting operation during heating, it is desirable to use a decrease in the low pressure refrigerant temperature similarly to the cooling refrigerant collecting operation, but since the low pressure refrigerant temperature also decreases because of a decrease in the air-sending rate due to air channel obstruction in the case of frosting in the heat source side heat exchanger 14, distinguishing between both phenomena is difficult using a determination based on a decrease in the low pressure refrigerant temperature. For this reason, in the refrigeration cycle apparatus 100, when the low pressure refrigerant temperature decreases, the defrosting operation and the heating refrigerant collecting operation are both performed. Specifically, for the low pressure refrigerant temperature, since refrigerant becomes a low pressure two-phase refrigerant from the heat source side pressure-reducing mechanism 13 to the liquid side of the heat source side heat exchanger 14, and the refrigerant temperature corresponds to the saturation temperature of the low-pressure side pressure, the refrigerant temperature is measured at some position therebetween. In the refrigeration cycle apparatus 100, when the refrigerant temperature detected by the temperature sensor 206 is detected to be a heating refrigerant collection start temperature or less (for example, −5 degrees C. or less) continuously for a predetermined time or more (for example, a continuous 7 minutes or more), operation proceeds to the defrosting operating mode E, and in addition, the refrigerant collection determination unit 105 determines that refrigerant collection is required, and the refrigerant collection controller 106 performs the heating refrigerant collecting operation. Herein, the temperature sensor 206 corresponds to a low pressure side refrigerant temperature detecting unit in the heating operating mode C of the refrigeration cycle apparatus 100.

Figure 8:
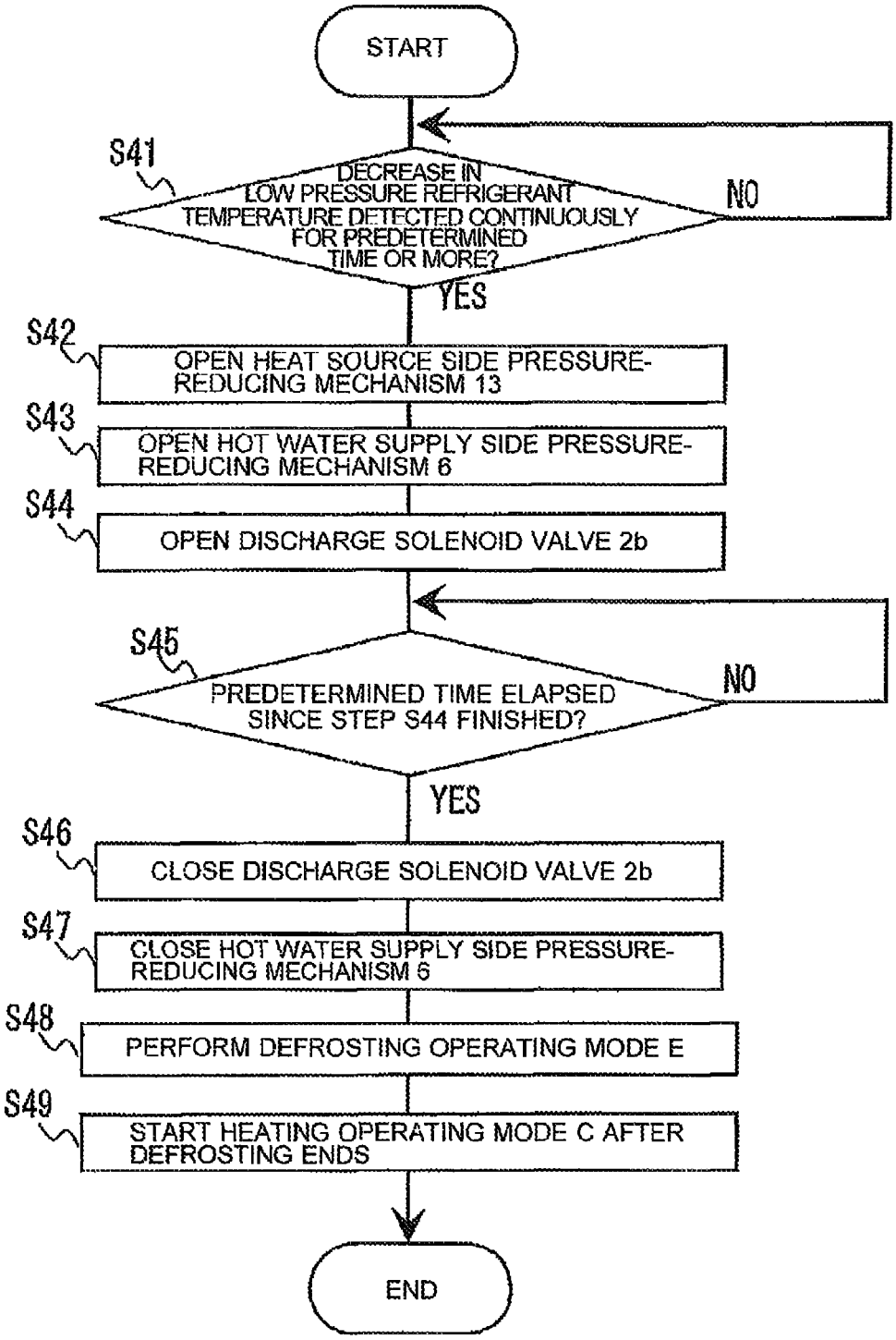
FIG. 8 is a flowchart illustrating an operating procedure when the low-pressure refrigerant temperature is reduced in a heating operating mode C of a refrigeration cycle apparatus 100.

Specifically, a method of operation when the low pressure refrigerant temperature decreases will be described using FIG. 8. In step S41, if a decrease in the saturation temperature of the low pressure refrigerant is detected continuously for a predetermined time or more, the refrigerant collection controller 106 judges to perform the heating refrigerant collecting operation indicated by the operation content from step S42 to step S47. The heat source side pressure-reducing mechanism 13 is opened in step S42, and after that, the hot water supply side pressure-reducing mechanism 6 is opened in step S43, and the discharge solenoid valve 2*b* is opened. By opening the hot water supply side pressure-reducing mechanism 6 and the discharge solenoid valve 2*b*, the refrigerant discharged from the compressor 1 divides into refrigerant that flows through the discharge solenoid valve 2*a* and refrigerant that flows through the discharge solenoid valve 2*b*, and the refrigerant that flows through the discharge solenoid valve 2*b* is able to pass through the hot water supply flow channel, thereby enabling the collection of accumulated refrigerant in the hot water supply flow channel into the heating main flow channel. Note that the reason for also opening the heat source side pressure-reducing mechanism 13 is because during the heating refrigerant collecting operation, the installation position of the heat source side pressure-reducing mechanism 13 is positioned downstream of the hot water supply flow channel, and if the opening degree of the heat source side pressure-reducing mechanism 13 is small, accumulated refrigerant in the hot water supply flow channel may not be pushed out with normal operation control in the heating operating mode C. In addition, the opening degrees when opening the heat source side pressure-reducing mechanism 13 and the hot water supply side pressure-reducing mechanism 6 are fixed to fully-open opening degrees, for example. Unlike the present refrigeration cycle apparatus, step S44 is unnecessary for a device without a discharge solenoid valve 2*b* on the discharge side of the compressor. In this case, in step S45 it is determined whether or not a predetermined time has elapsed since step S43 finished. Also, the operating frequency of the compressor 1 and the rotation speed of the heat source side blower 15 are kept fixed at the operating frequency and the rotation speed from the time when step S41 became YES.

In step S45, it is determined whether or not a predetermined time (for example, 1 minute) has elapsed since step S44 finished. The elapsed time herein corresponds to the refrigerant collecting time, and is a set time stored in the storage unit 104. After the predetermined time elapses, the discharge solenoid valve 2*b* is closed in step S46, the hot water supply side pressure-reducing mechanism 6 is closed in step S47, and the heating refrigerant collecting operation ends. Subsequently, operation proceeds to the defrosting operating mode E in step S48. Since the connection direction of the four-way valve 12 differs between the defrosting operating mode E and the heating operating mode C, the method of changing mode may involve, for example, temporarily stopping operation of the compressor 1, switching the connection direction of the four-way valve 12, and then starting operation of the compressor 1 again to proceed to the defrosting operating mode E. In step S49, the heating operating mode C starts after defrosting ends. The change to the heating operating mode C is conducted by following the procedure of stopping and starting the compressor, similarly to the switching in step S48.

As illustrated above, by performing the heating refrigerant collecting operation before the defrosting operation, it becomes possible to perform, as necessary, refrigerant collection of refrigerant accumulated in the hot water supply unit 303 with a method of detecting the low pressure refrigerant temperature, even without distinguishing refrigerant accumulation from frosting of the heat source side heat exchanger 14.

Also, when the outdoor air temperature is low (for example, −15 degrees C.), the low pressure refrigerant temperature becomes less than or equal to the heating refrigerant collection start temperature, irrespectively of the amount of refrigerant accumulation in the hot water supply flow channel. For this reason, during a refrigerant collection prohibited time from the end of the previous heating refrigerant collecting operation, operation is made to not proceed to the heating refrigerant collecting operation even if the low pressure refrigerant temperature becomes less than or equal to the heating refrigerant collecting operation start temperature. The refrigerant collection prohibited time in heating operating mode C may be set to the same 60 minutes as the defrosting prohibited time, for example, but may also be set to a longer or a shorter time, irrespectively of the defrosting prohibited time. In the case of setting a separate time from the defrosting prohibited time, if the low pressure temperature becomes less than or equal to the heating refrigerant collection start temperature during the defrosting prohibited time, the process from step S42 to step S45 and in step S49 of FIG. 8 is conducted, and only the heating refrigerant collecting operation is performed. Conversely, if during the refrigerant collection prohibited time, the process from step S48 to step S49 is conducted, and only the defrosting operation is performed.

Also, similarly to the cooling refrigerant collecting operation, even in the heating refrigerant collecting operation, because the heat source side pressure-reducing mechanism 13 installed in the heating main flow channel is opened, the refrigerant distributed in the indoor side heat exchanger 9 also flows to the low pressure side of the heating main flow channel, and a large amount of refrigerant flows to the accumulator 17. If this occurs, the suction part of the compressor becomes damp, and possibly causes malfunction due to a decrease in the oil concentration in the compressor 1. For this reason, during the heating refrigerant collecting operation, the refrigerant in the indoor side heat exchanger 9 is made not to flow by restricting the indoor side pressure-reducing mechanism 7, which is not positioned on the downstream side of the hot water supply flow channel, and through which refrigerant flowing through the hot water supply flow channel does not pass. Specifically, the opening degree of the heat source side pressure-reducing mechanism 13 immediately before the start of heating refrigerant collection is stored in the storage unit 104, and in the flowchart in FIG. 8, the indoor side pressure-reducing mechanism 7 is restricted to be less than or equal to the stored opening degree of the heat source side pressure-reducing mechanism 13 between step S42 and step S43. Subsequently, the indoor side pressure-reducing mechanism 7 is opened between step S47 and step S48. In so doing, during the heating refrigerant collecting operation, the opening degree of the indoor side pressure-reducing mechanism 7 is restricted and the hot water supply side pressure-reducing mechanism 6 is also opened, and thus the operating state becomes such that the degree of subcooling on the liquid side of the water side heat exchanger 4 is zero, and in addition, the degree of subcooling on the liquid side of the indoor side heat exchanger 9 is greater than zero. In other words, the outlet refrigerant temperature of the water side heat exchanger 4 becomes less than the refrigerant saturation temperature on the high pressure side, and in addition, the outlet refrigerant temperature of the indoor side heat exchanger 9 becomes equal to or greater than the refrigerant saturation temperature on the high pressure side. For this reason, a large amount of refrigerant no longer flows to the accumulator 17 or the compressor 1, the oil concentration in the compressor 1 no longer decreases, and device reliability improves. Note that the refrigerant saturation temperature on the high pressure side is the saturation temperature of the detected pressure from the pressure sensor 201, but is not limited thereto. A temperature may also be installed in a heat transfer pipe of the indoor side heat exchanger 9, and the detected temperature may also be used. In addition, the outlet refrigerant of the indoor side heat exchanger 9 refers to the refrigerant positioned between the indoor side heat exchanger 9 and the indoor side pressure-reducing mechanism 7.

The heating operating mode C may be performed even if the refrigerant collecting operation is performed before the defrosting operation, but ordinarily, in the case of measuring heating capacity when the outdoor air temperature is a low temperature such as 2 degrees C., the heating operating mode C operates through the defrosting operating mode E, and thus the heating capacity is evaluated by also including heating losses during the defrosting operation. For example, if the defrosting prohibited time and the refrigerant collection prohibited time are the same, and the heating refrigerant collecting operation is always performed before the defrosting operation, the time from detecting a decrease in the low pressure refrigerant temperature until the end of defrosting becomes long, thereby impairing the heating capacity at low temperatures. Accordingly, an example will be described in which the start determination for the refrigerant collecting operation may be determined by an indicator different from the low pressure refrigerant temperature.

Figure 9:
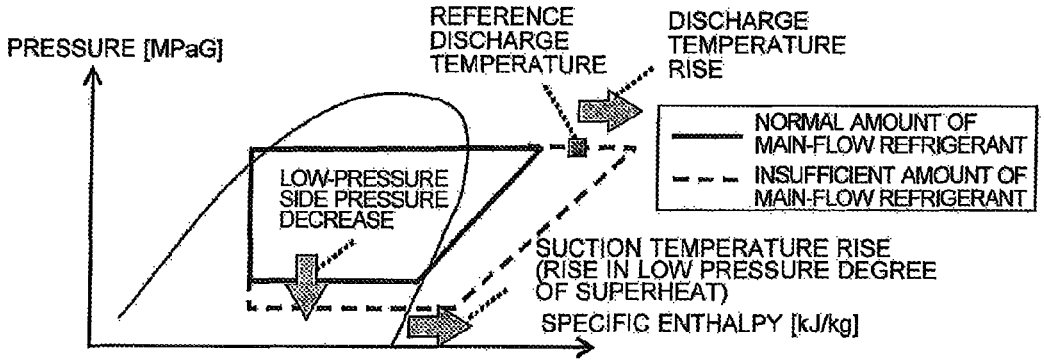
FIG. 9 is a schematic diagram illustrating a comparison of the operating state between a normal and an insufficient refrigerant flow rate in a main flow channel in a heating operating mode C of a refrigeration cycle apparatus 100.

FIG. 9 is a schematic diagram illustrating difference in the operating state between the cases of a normal and an insufficient amount of refrigerant in the heating main flow channel. If the refrigerant amount in the main flow channel is insufficient, the low-pressure side pressure decreases compared to normal, and moreover, the suction temperature, which is the temperature of the suction part of the compressor 1, rises, and as a result, the discharge temperature rises. If the start determination of the refrigerant collecting operation is made according to this rise in the discharge temperature or the suction temperature (the degree of superheat on the low pressure side), the difference from the operating state due to frosting of the heat source side heat exchanger 14 may be distinguished. However, at this point, if the start determination temperature is set to a fixed value to simply determine whether or not the discharge temperature is a designated value or more (for example, 105 degrees C. or more), when the indoor temperature is low or the outdoor air temperature is high, the difference between the high-pressure side pressure and the low-pressure side pressure is small, and thus there is a possibility that the discharge temperature will not rise to the determination threshold or above even if the refrigerant amount is insufficient, and the defrosting operation will be started due to the low-pressure side pressure decreasing. For this reason, a reference discharge temperature is set for each operating state, and when the discharge temperature becomes equal to or greater than the reference discharge temperature, the refrigerant collection determination unit 105 determines that the refrigerant collecting operation is required, and performed the heating refrigerant collecting operation. In other words, the operation from step S42 to step S47 illustrated in the flowchart of FIG. 8 is performed. Herein, the discharge temperature refers to the detected temperature of the temperature sensor 202. Note that in the case of performing the heating refrigerant collecting operation according to the discharge temperature, when the low pressure temperature decreases, only step S48 and step S49 in the flowchart of FIG. 8 are performed to perform only the defrosting operating mode E without performing the heating refrigerant collecting operation.

The reference discharge temperature is the discharge temperature when the suction degree of superheat of the compressor 1 is a designated value (for example, a suction degree of superheat of 7 degrees C.), and differs depending on the type of compressor (such as whether the compression method is scroll-type or rotary-type). A reference discharge temperature relational expression depending on the type of compressor installed onboard the refrigeration cycle apparatus 100 is stored in the storage unit 104, and computed from operating data of the refrigeration cycle apparatus. In the refrigeration cycle apparatus 100, the reference discharge temperature may be computed from the high-pressure side pressure, the low-pressure side pressure, and the operating frequency of the compressor 1 by using the reference discharge temperature relational expression. Herein, in the heating operating mode C, the high-pressure side pressure is the detected pressure of the pressure sensor 201, while the low-pressure side pressure is the saturation gas pressure of the detected temperature of the temperature sensor 206.

Also, in the cooling operating mode B, when the discharge temperature becomes equal to or greater than the reference discharge temperature, or when the degree of superheat on the low pressure side becomes equal to or greater than a fixed value, the refrigerant collecting operation, or in other words the cooling refrigerant collecting operation, may be performed. If the cooling refrigerant collection start temperature is a fixed value, when the indoor temperature is high, the low pressure refrigerant temperature does not fall to the threshold value, and operation continues for some time. Since the suction temperature is high, the refrigerant temperature and the degree of superheat on the gas side of the indoor side heat exchanger 9 become high, and dew formation and dew flying occur in the indoor unit 302, possibly impairing user comfort. Avoiding this situation becomes possible.

Note that the reference positions of the discharge temperature and the high-pressure side pressure are similar to the heating operating mode C, but for the low-pressure side pressure, the indoor side heat exchanger 9 becomes a low pressure environment, and thus the saturation gas pressure of the detected temperature of the temperature sensor 203 is used.

<Hot Water Supply Operating Mode D>

In normal operation control of the hot water supply operating mode D, the four-way valve 12 connects the suction side of the compressor 1 to the gas side of the heat source side heat exchanger 14. Also, the discharge solenoid valve 2*a* closes, the discharge solenoid valve 2*b* opens, and the solenoid valve 16 closes. Furthermore, the indoor side pressure-reducing mechanism 7 is fixed at the minimum opening degree, while the hot water supply side pressure-reducing mechanism 6 is fixed at the maximum opening degree.

High temperature and high pressure gas refrigerant discharged from the compressor 1 flows into the discharge solenoid valve 2*b*, and flows into the water side heat exchanger 4 via the water side gas extension pipe 3. Refrigerant flowing into the water side heat exchanger 4 heats water medium supplied by the water pump 18 to become high pressure liquid refrigerant, and flows out. After that, the high pressure liquid refrigerant passes through the hot water supply side pressure-reducing mechanism 6 via the water side liquid extension pipe 5, and is depressurized by the heat source side heat exchanger 14 to become low pressure two-phase refrigerant. At this point, the hot water supply side pressure-reducing mechanism 6 is controlled so that the degree of subcooling on the liquid side of the water side heat exchanger 4 becomes a designated value. The refrigerant, after passing through the heat source side pressure-reducing mechanism 13, flows into the heat source side heat exchanger 14, and cools outdoor air supplied by the heat source side blower 15 to becomes low pressure gas refrigerant. After that, the refrigerant passes through the accumulator 17 via the four-way valve 12, and is suctioned into the compressor 1 again. The compressor 1 is controlled at the maximum frequency, with the aim of maximizing hot water supply capacity and boiling water in a short time. Also, the rotation speed of the heat source side blower 15 is decided according to the outdoor air temperature.

In the hot water supply operating mode D, the discharge solenoid valve 2*a* is opened and the indoor side pressure-reducing mechanism 7 is at a minimum opening degree, but since refrigerant still flows along the flow channel of the indoor unit 302 in small amounts from structural gaps and the like, refrigerant condenses in the indoor flow channel made up of the indoor side heat exchanger 9, the indoor side gas extension pipe 11, and the indoor side liquid extension pipe 8, and over the time of operation, refrigerant accumulates in the indoor flow channel. For this reason, it is necessary to detect refrigerant accumulation in the indoor flow channel, and collect refrigerant in the indoor flow channel into the hot water supply main flow channel of the refrigerant circuit. Herein, the hot water supply main flow channel refers to the flow channel described earlier, which flows from the compressor 1 to the discharge solenoid valve 2*b*, the water side heat exchanger 4, the hot water supply side pressure-reducing mechanism 6, the heat source side heat exchanger 14, the accumulator 17, and the compressor 1.

If refrigerant becomes insufficient in the hot water supply main flow channel, the low-pressure side pressure decreases, but since the low-pressure side pressure also decreases from the frosting phenomenon in heat source side heat exchanger 14, ordinarily, the defrosting operating mode E starts when the low-pressure side pressure decreases during the hot water supplying operation. In the defrosting operating mode E, the refrigerant in the indoor flow channel is in a low pressure environment. For this reason, accumulated refrigerant in the indoor flow channel may be collected by switching to the defrosting operating mode E, and thus collecting accumulated refrigerant in the indoor unit according to a decrease in the low pressure refrigerant temperature similar to the start determination for the defrosting operation does not pose a problem.

However, when the water side gas extension pipe 3 and the water side liquid extension pipe 5 are long, or when the temperature of water flowing into the water side heat exchanger 4 is low and a large amount of refrigerant is distributed due to much of the refrigerant being cooled and condensed by the water side heat exchanger 4, proceeding to the defrosting operating mode E without collecting the refrigerant distributed on the hot water supply unit 303 side causes operation with insufficient refrigerant and the low-pressure side pressure decreases, which not only lengthens the defrosting operation time, but possibly also prevents the complete removal of frost over any length of time. For this reason, after the defrosting operation start determination is established, it is necessary to perform a hot water supply refrigerant collecting operation that collects refrigerant on the hot water supply unit 303 side before performing the defrosting operation.

Figure 10:
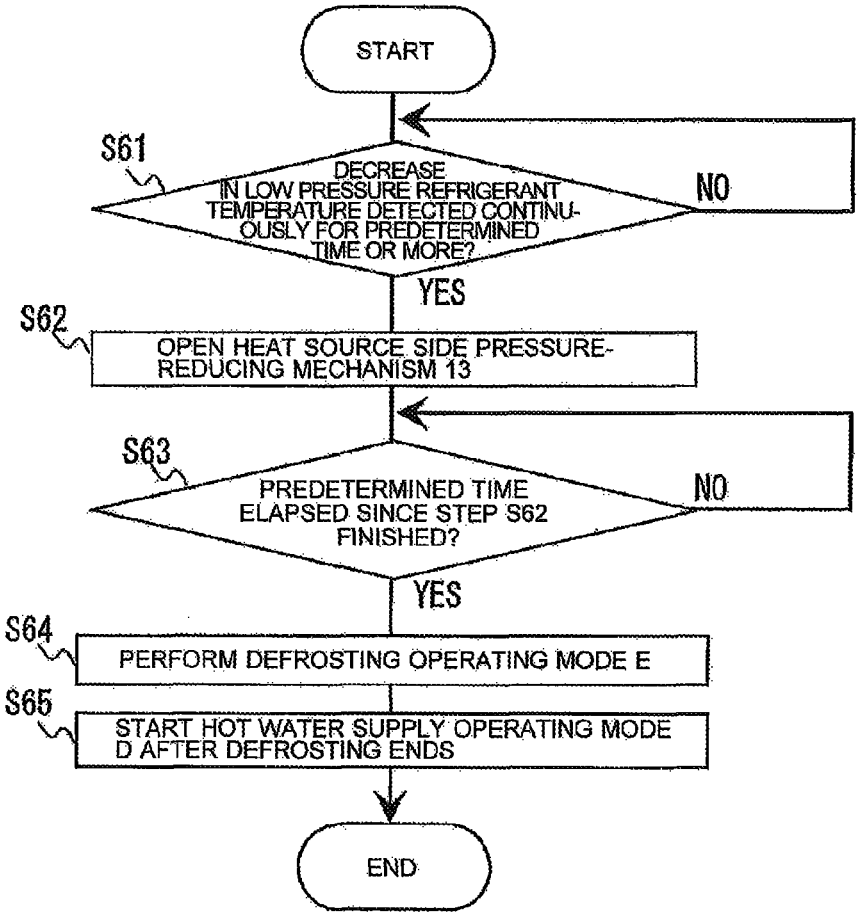
FIG. 10 is a flowchart illustrating an operating procedure when the low-pressure refrigerant temperature is reduced in a water-heating operating mode D of a refrigeration cycle apparatus 100.

Specifically, a method of operation when the low pressure refrigerant temperature decreases will be described using FIG. 10. In step S61, if a decrease in the saturation temperature of the low pressure refrigerant is detected for a predetermined time or more, the refrigerant collection controller 106 judges to perform the hot water supply refrigerant collecting operation indicated by the operation content from step S62 to step S63. Note that if the low pressure refrigerant temperature becomes less than or equal to a hot water supply refrigerant collection start temperature (for example, the same as the defrosting start temperature), step S61 becomes YES. For the low pressure refrigerant temperature, since refrigerant becomes a low pressure two-phase refrigerant from the heat source side pressure-reducing mechanism 13 to the liquid side of the heat source side heat exchanger 14, and the refrigerant temperature corresponds to the saturation temperature of the low-pressure side pressure, the refrigerant temperature is measured at some position therebetween. Herein, the temperature sensor 206 corresponds to a low pressure side refrigerant temperature detecting unit in the hot water supply operating mode D of the refrigeration cycle apparatus 100. Next, in step S62, the heat source side pressure-reducing mechanism 13 is opened. This is because opening the heat source side pressure-reducing mechanism 13 that had been restricted by the normal operation control of the hot water supply operating mode D causes the degree of subcooling on the liquid side of the water side heat exchanger 4 to become zero, enabling the collection of refrigerant accumulated in the hot water supply unit 303 into the heat source unit 301. Also, the opening degree when opening the heat source side pressure-reducing mechanism 13 and the hot water supply side pressure-reducing mechanism 6 may be set to the fully-open opening degree or 1.5 times the current opening degree (if the current opening degree is 140 pulses, the opening degree is set to 210 pulses), for example. Also, the operating frequency of the compressor 1 and the rotation speed of the heat source side blower 15 are kept fixed at the operating frequency and the rotation speed from the time when step S61 became YES.

Next, in step S63, if it is determined that a predetermined time or more (for example, 1 minute or more) has elapsed since step S62 finished, the hot water supply refrigerant collecting operation ends. Subsequently, operation proceeds to the defrosting operating mode E in step S64, and when defrosting ends, the hot water supply operating mode D starts in step S65. As above, since refrigerant in the hot water supply flow channel is collected before proceeding to the defrosting operating mode E, operation with insufficient refrigerant during the defrosting operation is eliminated, and extreme lengthening of the defrosting time or incomplete defrosting may be avoided. Also, since accumulated refrigerant in the indoor unit 302 may be collected, an insufficiency of refrigerant in the hot water supply main flow channel in the hot water supply operating mode D may be avoided. Herein, the refrigerant collection prohibited time is made to be similar to the defrosting prohibited time.

In addition, a switch (for example, a DipSW) for forcibly causing the refrigerant collecting operation to be performed in the heat source unit 301 is provided, and when the switch is pressed, the refrigerant collection determination unit 105 determines that refrigerant collection is required, enabling the refrigerant collecting operation in the corresponding operating mode to be performed forcibly. Specifically, if the operating mode when the switch is pressed is the cooling operating mode B, the cooling refrigerant collecting operation is performed, whereas in the case of the heating operating mode C, the heating refrigerant collecting operation is performed, and in the case of the hot water supply operating mode D, the hot water supply refrigerant collecting operation is performed. By adding such a configuration, it becomes possible to perform the refrigerant collecting operation at arbitrary timings when measuring capacity for testing or the like. Consequently, the refrigerant amount in the main flow channel may be adjusted to the correct amount at any time, enabling capacity acquisition and other operational inspections to be carried out appropriately.

Embodiment 2

Apparatus Configuration

Figure 11:
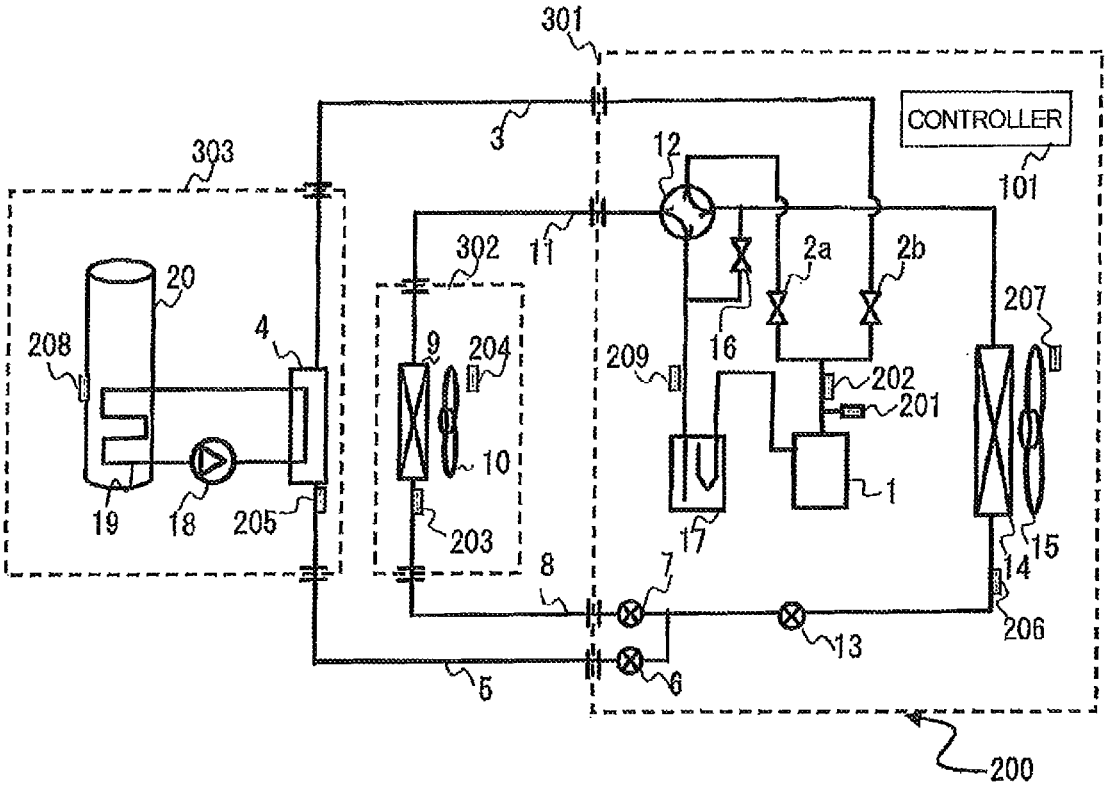
FIG. 11 is a schematic diagram illustrating a refrigerant circuit configuration in a refrigeration cycle apparatus 200.

A configuration of a refrigeration cycle apparatus 200 of Embodiment 2 will be described using FIG. 11. The refrigeration cycle apparatus 200 has entirely the same configuration as the refrigeration cycle apparatus 100, except that a temperature sensor 209 is installed in the heat source unit 301. In Embodiment 2, an example of a configuration that detects the low pressure gas refrigerant temperature is illustrated. In the refrigeration cycle apparatus 200, the temperature sensor 209 is installed at the suction part of the accumulator 17, enabling measurement of the refrigerant temperature at the installation location. In the cooling operating mode B, the space from the indoor side heat exchanger 9 up to the suction part of the compressor 1 is a section in which low pressure gas refrigerant is distributed, and thus it is sufficient to install a temperature sensor at some position therebetween. Also, in the heating operating mode C, the space from the heat source side heat exchanger 14 up to the suction part of the compressor 1 is a section in which low pressure gas refrigerant is distributed, and thus it is sufficient to install a temperature sensor at some position therebetween.

In the cooling operating mode B, the installation of the temperature sensor 209 enables the detection of the degree of low-pressure superheat. The degree of low-pressure superheat in the cooling operating mode B is computed by subtracting the detected temperature of the temperature sensor 203 from the detected temperature of the temperature sensor 209. If refrigerant becomes insufficient in the cooling main flow channel, the low-pressure side pressure decreases while the degree of low-pressure superheat also rises, and thus when the degree of low-pressure superheat becomes a designated value or more (for example, 7 degrees C. or more), the refrigerant collection determination unit 105 determines that refrigerant collection is required, and is able to perform the cooling refrigerant collecting operation. In so doing, an excessive increase in the indoor side heat exchanger 9 may be determined with a simple determination method, and in addition, be avoided more reliably, and the occurrence of dew formation or dew flying in the indoor side heat exchanger 9 may be moderated.

In the heating operating mode C, the installation of the temperature sensor 209 enables the detection of the degree of low-pressure superheat, and thus when the degree of low-pressure superheat becomes a designated value or more (for example, 7 degrees C. or more), the refrigerant collection determination unit 105 determines that refrigerant collection is required, and is able to perform the heating refrigerant collecting operation. At this point, the degree of low-pressure superheat in the heating operating mode C is computed by subtracting the detected temperature of the temperature sensor 206 from the detected temperature of the temperature sensor 209. In so doing, a start determination different from the start determination for the defrosting operation may be used, making it possible to avoid impairing the heating capacity at low temperatures. Additionally, information to be stored, such as a relational expression, may be reduced compared to the determination based on a reference discharge temperature, and in addition, computational operations are also reduced. Consequently, the computational load may be reduced.

REFERENCE SIGNS LIST

1 compressor 2*a*, 2*b* discharge solenoid valve 3 water side gas extension pipe 4 water side heat exchanger 5 water side liquid extension pipe 6 hot water supply side pressure-reducing mechanism 7 indoor side pressure-reducing mechanism 8 indoor side liquid extension pipe 9 indoor side heat exchanger 10 indoor side blower 11 indoor side gas extension pipe 12 four-way valve 13 heat source side pressure-reducing mechanism 14 heat source side heat exchanger 15 heat source side blower 16 solenoid valve 17 accumulator 18 water pump 19 coil heat exchanger 20 hot water tank 100 refrigeration cycle apparatus 101 controller 102 measurement unit 103 normal operation controller 104 storage unit 105 refrigerant collection determination unit 106 refrigerant collection controller 107 time measurement unit 200 refrigeration cycle apparatus 201 pressure sensor 202-209 temperature sensor 301 heat source unit 302 indoor unit 303 hot water supply unit

The invention claimed is:

1. A refrigeration cycle apparatus comprising:

a controller;

a refrigeration cycle circuit including a compressor, a four-way valve, a heat source side heat exchanger, a heat source side pressure-reducing mechanism, an indoor side pressure-reducing mechanism, and an indoor side heat exchanger, in which during cooling operation, the compressor, the four-way valve, the heat source side heat exchanger, the heat source side pressure-reducing mechanism, the indoor side pressure-reducing mechanism, and the indoor side heat exchanger are connected to allow refrigerant to circulate therethrough in named order; and a hot water supply refrigerant circuit branching off from between the compressor and the four-way valve, including a hot water supply side heat exchanger and a hot water supply side pressure-reducing mechanism connected in named order, the hot water supply refrigerant circuit being connected between the heat source side pressure-reducing mechanism and the indoor side pressure-reducing mechanism, the controller being configured to start a refrigerant collecting operation that collects refrigerant accumulated in the hot water supply refrigerant circuit into the refrigeration cycle circuit when a refrigerant state value on at least one of a low pressure side of the refrigeration cycle circuit and a discharge side of the compressor becomes a refrigerant collection start state value, wherein the controller is configured to control, in the refrigerant collecting operation, the opening degree of the heat source side pressure-reducing mechanism or the indoor side pressure-reducing mechanism, corresponding to one of the heat source side heat exchanger and the indoor side heat exchanger serving as a condenser, to be more than a fully closed opening degree and less than the opening degree of the heat source side pressure-reducing mechanism or the indoor side pressure-reducing mechanism corresponding to an other of the heat source side heat exchanger and the indoor side heat exchanger serving as an evaporator, and the opening degree of the hot water supply side pressure-reducing mechanism.

2. The refrigeration cycle apparatus of claim 1, wherein the controller is configured to, in the refrigerant collecting operation, control an outlet refrigerant temperature of a heat exchanger, serving as a condenser from among the heat source side heat exchanger and the indoor side heat exchanger, to be less than a refrigerant saturation temperature on a high pressure side, and control an outlet refrigerant temperature of the hot water supply side heat exchanger to be equal to or greater than the refrigerant saturation temperature on the high pressure side.

3. The refrigeration cycle apparatus of claim 1, further comprising a discharge solenoid valve provided between the compressor and the hot water supply heat exchanger, and being configured to open at the start of the refrigerant collecting operation.

4. The refrigeration cycle apparatus of claim 3, wherein the controller is configured to, when starting the refrigerant collecting operation, open the discharge solenoid valve of the hot water supply refrigerant circuit after opening the hot water supply side pressure-reducing mechanism.

5. The refrigeration cycle apparatus of claim 4, wherein the controller is configured to, when starting the refrigerant collecting operation, lower a rotation speed of the compressor to a first preset value when the hot water supply side pressure-reducing mechanism is opened, and raise the rotation speed of the compressor to a second preset value equal to or greater than the first preset value when the discharge solenoid valve is opened.

6. The refrigeration cycle apparatus of claim 1, wherein the refrigerant state value is a refrigerant saturation pressure or a refrigerant saturation temperature on a low pressure side of the refrigeration cycle circuit, and the controller is configured to start the refrigerant collecting operation when the refrigerant saturation pressure on the low pressure side decreases to a preset refrigerant collection start pressure or less, or when the refrigerant saturation temperature on the low pressure side decreases to a preset refrigerant collection start temperature or less.

7. The refrigeration cycle apparatus of claim 6, wherein the controller is configured to start the refrigerant collecting operation when a temperature difference between an indoor air temperature of indoor air to be air-conditioned and the refrigerant saturation temperature on the low pressure side becomes equal to or greater than a preset refrigerant collection start temperature difference.

8. The refrigeration cycle apparatus of claim 7, wherein the controller is configured to change, according to an operating frequency of the compressor, the refrigerant collection start temperature difference.

9. The refrigeration cycle apparatus of claim 6, wherein the controller is configured to execute a freeze protection control in which the compressor stops when the refrigerant saturation pressure on the low pressure side or the refrigerant saturation temperature on the low pressure side decreases to a first prescribed value or less during cooling operation, and set the refrigerant collection start pressure or the refrigerant collection start temperature to a value equal to or greater than the first prescribed value.

10. The refrigeration cycle apparatus of claim 9, wherein the refrigerant collecting operation is unexecuted for a fixed time since an end time of a previous refrigerant collecting operation when an indoor temperature or an outdoor air temperature is a predetermined value or less.

11. The refrigeration cycle apparatus of claim 6, wherein the controller is configured to perform a defrosting operation when the refrigerant saturation pressure on the low pressure side or the refrigerant saturation temperature on the low pressure side decreases to a second prescribed value or less during a heating operation, and set the refrigerant collection start pressure or the refrigerant collection start temperature to a value equal to or greater than the second prescribed value.

12. The refrigeration cycle apparatus of claim 1, wherein:

the refrigerant state value is a degree of superheat of refrigerant on the low pressure side of the refrigeration cycle circuit or a discharge temperature of the compressor, and the controller is configured to start the refrigerant collecting operation when the degree of superheat of refrigerant on the low pressure side rises to a preset value or more, or when the discharge temperature of the compressor rises to a preset value or more.

13. The refrigeration cycle apparatus of claim 1, wherein the controller is configured to perform the refrigerant collecting operation after determining that a condition for starting defrosting operation start is established, and before the defrosting operation.

14. The refrigeration cycle apparatus of claim 1, wherein the controller is configured to, in the refrigerant collecting operation, control the opening degree of the heat source side pressure-reducing mechanism corresponding to the heat source side heat exchanger serving as a condenser, to be equal to or less than the opening degree of the indoor side pressure-reducing mechanism corresponding to the indoor side heat exchanger serving as an evaporator immediately before starting of the refrigerant collecting operation.

* * * * *